US012274389B2

(12) United States Patent
Zahner

(10) Patent No.: US 12,274,389 B2
(45) Date of Patent: Apr. 15, 2025

(54) TRACK AND CURTAIN SYSTEM

(71) Applicant: David Zahner, Aventura (FI)

(72) Inventor: David Zahner, Aventura (FI)

(73) Assignee: Zahner Design Group, Ltd., Boca Raton, FL (US)

( * ) Notice: Subject to any disclaimer, the term of this patent is extended or adjusted under 35 U.S.C. 154(b) by 0 days.

(21) Appl. No.: 17/981,134

(22) Filed: Nov. 4, 2022

(65) Prior Publication Data

US 2023/0053653 A1 Feb. 23, 2023

Related U.S. Application Data

(63) Continuation of application No. 15/863,345, filed on Jan. 5, 2018, now Pat. No. 11,612,264, which is a continuation of application No. 14/451,667, filed on Aug. 5, 2014, now Pat. No. 10,085,582, which is a continuation-in-part of application No. 14/159,820,
(Continued)

(30) Foreign Application Priority Data

Jul. 21, 2014 (EM) ..... 002506477

(51) Int. Cl.

| | |
|---|---|
| ***A47H 1/04*** | (2006.01) |
| ***A47H 1/08*** | (2006.01) |
| ***A47H 1/14*** | (2006.01) |
| ***A47H 1/144*** | (2006.01) |
| ***A47H 13/02*** | (2006.01) |
| ***A47H 13/04*** | (2006.01) |

(52) U.S. Cl.
CPC ..... *A47H 1/04* (2013.01); *A47H 1/08* (2013.01); *A47H 1/14* (2013.01); *A47H 1/144* (2013.01); *A47H 13/02* (2013.01); *A47H 13/04* (2013.01); *A47H 2201/02* (2013.01)

(58) Field of Classification Search
CPC ... A47H 1/04; A47H 1/08; A47H 1/14; A47H 1/144; A47H 1/142; A47H 13/02; A47H 13/24; A47H 13/00; A47H 2201/02; A47H 15/04
See application file for complete search history.

(56) References Cited

U.S. PATENT DOCUMENTS 3,192,994 A * 7/1965 Graber ..... A47H 5/03 160/126
3,881,218 A * 5/1975 Palmer ..... A47H 1/104 16/95 D (Continued)

*Primary Examiner* — Justin B Rephann
(74) *Attorney, Agent, or Firm* — Goldberg Cohen LLP

(57) ABSTRACT

A modular track system for hanging a curtain, the track system consisting of modules or sections with attachments and accessories designed to adjust to varying environments and specifications. Track shape and length are adjusted by specifying various combinations of the specialized components created as part of the system. Complementing the track system is a curtain with integrated loop fasteners which allows the curtain to be attached and removed without removing the track. The system further preferably includes a side support for use in attached the track to a fixed support in the environment, and a guiderail on the side of the track on one or more track sections, the track and curtain all being coordinated to form an efficient and improved curtain hanging system.

7 Claims, 43 Drawing Sheets

Related U.S. Application Data filed on Jan. 21, 2014, now abandoned, which is a continuation-in-part of application No. 13/852,874, filed on Mar. 28, 2013, now abandoned, which is a continuation of application No. 12/290,989, filed on Nov. 5, 2008, now Pat. No. 8,408,275, which is a continuation of application No. PCT/US2007/025328, filed on Dec. 11, 2007.

(60) Provisional application No. 60/964,101, filed on Aug. 9, 2007, provisional application No. 60/874,637, filed on Dec. 13, 2006.

(56) References Cited

U.S. PATENT DOCUMENTS 4,015,310 A * 4/1977 MacFarlane ..... A47H 13/04 16/87.4 R
4,123,820 A * 11/1978 Hamilton ..... A47H 1/04 16/95 D
4,221,020 A * 9/1980 Wertepny ..... A47H 5/04 160/342
5,186,232 A * 2/1993 Zahner ..... A47H 23/10 160/390
6,059,009 A * 5/2000 Haiber ..... A47H 13/02 160/330
6,189,597 B1 * 2/2001 Cheng ..... A47H 13/02 24/716
6,223,389 B1 * 5/2001 Walsh ..... A47H 13/00 16/95 D
6,494,248 B1 * 12/2002 Zahner ..... A47K 3/38 160/390
6,866,082 B1 * 3/2005 Zahner ..... A47K 3/38 160/390
7,296,609 B2 * 11/2007 Zahner ..... E06B 9/38 160/390
10,767,685 B2 * 9/2020 Bauer ..... F16B 45/00
2006/0037721 A1 * 2/2006 Zahner ..... E06B 9/38 160/330
2006/0260769 A1 * 11/2006 Nien ..... A47H 1/00 160/330
2008/0178423 A1 * 7/2008 Patel ..... A47K 3/38 16/87.2
2009/0032659 A1 * 2/2009 Goldstein ..... A47H 13/01 248/220.21
2010/0319858 A1 * 12/2010 Freedland ..... A47H 1/02 24/716
2010/0325836 A1 * 12/2010 Lai ..... A47H 1/02 16/87.2
2011/0062099 A1 * 3/2011 McCormack ..... A47H 15/02 211/124
2011/0225774 A1 * 9/2011 Seddon ..... A47H 1/04 16/94 D
2013/0019395 A1 * 1/2013 Pierce ..... A47K 3/38 4/610
2014/0174677 A1 * 6/2014 Ho ..... A47H 13/02 160/330
2014/0311692 A1 * 10/2014 Ho ..... A47H 15/04 160/330

* cited by examiner

Curtains Overlapping at Ends to Create an Entry or Exit Point

Detail A

Detail A

TRACK AND CURTAIN SYSTEM

CROSS-REFERENCE TO RELATED APPLICATIONS

The present application is a continuation of U.S. patent application Ser. No. 15/863,345 filed on Jan. 5, 2018 (pending), which is a continuation of U.S. patent application Ser. No. 14/451,667 filed Aug. 5, 2014 (pending), which is a continuation-in-part of U.S. patent application Ser. No. 14/159,820 filed Jan. 21, 2014 (abandoned), which is a continuation-in-part of U.S. patent application Ser. No. 13/852,874 filed Mar. 28, 2013 (pending), which is a continuation of U.S. patent application Ser. No. 12/290,989 filed Nov. 5, 2008 (patented—U.S. Pat. No. 8,408,275), which is a continuation of PCT Application Serial No. PCT/US2007/025328 filed Dec. 11, 2007, which claims all rights of priority to U.S. Provisional Application Ser. No. 60/874,637 filed Dec. 13, 2006 ("the '637 application"), and U.S. Provisional Application Ser. No. 60/964,101 filed Aug. 9, 2007.

The present application also claims priority of Registered Community Design Application No. 002506477 filed Jul. 21, 2014 in the Office for Harmonization in the Internal Market.

The priority of all of those prior applications is claimed, all of which are fully incorporated herein by reference.

FIELD OF THE INVENTION

The present invention relates to a track system and associated curtain for use as a room divider or to create an enclosed space. In preferred embodiments, the invention can be used as a hospital privacy curtain system, or in related applications.

BACKGROUND OF THE INVENTION

Throughout hospitals and extended care facilities, bed and examination areas are often provided privacy through the use of ceiling-mounted movable fabric curtains. There are many manufacturers of these products and all are essentially the same basic idea with limited variation. FIGS. 1*a* and 1*b* illustrate some examples of these systems of the prior art. As shown in the figures, a track is provided which consists of an extruded aluminum channel. The track is attached to a conventional or dropped ceiling, and traces a path around the area to be sequestered. A series of rollers slide within that track, each of the rollers having a chain hanging from it. The chains, in turn, each end in a hook.

To drape a curtain around the examination area, each hook is attached to a grommet in the curtain, a series of grommets being provided along the curtain's upper edge. Once the hooks have been attached to the curtain's grommets, the curtain hangs from the ceiling and can slide along the track's path. Usually, this path is arc-shaped, extending around three sides of a bed or examination area (the fourth side often being a wall). A health care professional such as a doctor or nurse pulls the curtain to slide it along the track, to open and close a space around the bed.

The present inventors have identified extensive shortcomings to these current systems. Because of the track, the rollers, and the moving parts, the noise of the curtain sliding along the aluminum track is very disturbing to patients. Particularly in a hospital environment, patients need their rest. Yet, the movement of the curtain along the track not only disturbs the patient in the bed surrounded by the curtain, but also the patient in the adjoining bed (which is a problem in general, and particularly so if that second patient was sleeping).

Furthermore, maintenance, repair and laundering of these systems is highly inefficient. The existing designs use a single entry and exit point for insertion or removal of the curtain at an end of the track (or at the two ends of the track at best). If one roller breaks in the sequence of rollers, all the rollers and the entire curtain up to that point need to be removed from the track, so that the broken roller can be replaced.

Likewise, the curtain can often disengage from the track. Particularly considering the large number of hooks and rollers and small parts, it is time consuming to maintain and repair the system and its parts, and to reattach the curtain. Yet, the number of moving parts only increases the likelihood of breakage, of the curtain disengaging from the track, of the disengagement of the hooks from the grommets, and so forth.

The curtains themselves consist of a single, continuous, lengthy stretch of material (usually greater than 24 feet, and often 30 feet long) and are heavy as a result. Due to that length and size, they must be sent out to a costly commercial laundering facility.

Moreover, the design of the system and the curtain's weight make it difficult to handle the curtain, with it being particularly cumbersome to hang or change it. One roller at a time must be inserted into the track and then one hook at a time must be attached to the heavy curtain. As there are approximately two grommets per linear foot, the mounting or removal of the curtain (whether for maintenance, repair, cleaning, or replacement purposes) is a considerable chore that usually requires the efforts of two maintenance workers.

The utility and aesthetics of the system are also severely lacking. To pass beyond the curtain into the bed area, the health care professional must pull the curtain from the far end—i.e. he or she cannot simply enter in the middle. Also, the movement of the curtain is often not smooth or stable along the track, and can jam up when there is interference with the moving parts. The curtain can also get tangled as the hooks catch each other and/or sections of the curtain fabric. The use of the chains, rollers and hooks also results in a configuration where the curtain hangs a significant distance below the track, leaving a relatively large gap through which unwanted light can enter.

In terms of both appearance and space, the existing curtains stack or gather together in an extremely wide silhouette—for example, 24 feet of curtain stack as approximately 4 feet, in other words, as a width of fabric approximately 4 feet wide. Moreover, since the curtain is a single continuous length, it can only be stacked together in one bundle. For all practical purposes, curtains in that system cannot be layered one on top of the other, even if desired. Also, the upper edge of the curtain is sloppy in appearance—whether spread or stacked.

Additionally, the products are usually custom created for the installation, creating long lead times and high prices for the institution. The system is also relatively costly due to the complicated ring system, the multiple parts, the use of the grommets, and the attendant higher labor involved. Likewise, most parts of those systems are metal, which are inherently noisier, may tarnish, and can be relatively expensive in cost.

SUMMARY OF THE INVENTION

In accordance with the invention, a system is provided for hanging an associated curtain, the modules of the system including a series of track sections. The track sections are each configured as a combination or hybrid of a rod and a track, with the benefits of both. The track sections are further being configured for attachment to each other, forming an extremely adaptable system for use in suspending a curtain therefrom.

As a result, a modular track or rod and modular curtain system is provided which can easily accommodate a facility's requirements while overcoming the shortcomings of the prior art. The track modules or sections have with attachments and accessories designed to conform and adjust to varying environments and specifications. The track shape and length are adjusted by specifying various combinations of the modular parts, the product being attached to various media with the use of the specialized components created as part of the system.

In a preferred embodiment of the invention, the system includes at least two track sections which are attached together to form a length of said track, wherein at least one track section includes a guiderail projecting from the body of that track section.

In a further additional or alternative embodiment of the invention, the system includes a side mount and/or a vertical mount for attaching the track system to a fixed support in the environment, wherein the side mount and/or vertical mount is attached to the side of the length of track.

Complementing the track system is a curtain with integrated loop fasteners which allows the curtain to be attached and removed without removing the track. In accordance with one embodiment of the invention, a unique opening is provided in the ring to provide a ring mouth which allows the curtain to easily pass over the track's mounting points (such as the side mount and/or vertical mount), and/or over the guiderail. The ring also allows attachment of the curtain to the track in one movement. Further preferably, the curtain is a modular design allowing the user to create various lengths, widths and configurations.

In a hospital environment, or other high stress environments, there are often times when hospital personnel handle the curtain in a violent and haphazard manner which may cause the curtain to fall off of the track at certain points. In those situations, a preferred embodiment would be to have an inward facing finger-like extension protruding from the mouth of the ring. This would create a superior interface between the ring and the side support, for extra stability. There are various different versions of this preferred embodiment. Further, in this alternative embodiment there can be a flap of fabric or material between the rings of the curtain which blocks light from coming through. If the light shines through the curtain through the opening between the rings this can be disturbing to a patient who is in a bed behind the curtain. This flap would attach to the upper side of the opening and extend below the lower part of the opening to cover that gap without interfering with the curtain's movement along the track. Likewise, the side stabilizer will be positioned higher on the track so it can go under the guiderail.

Likewise, a loading zone can be included on the track. The loading zone is a thinned out section at the beginning of the track which the rings of the curtain are initially loaded onto, and the narrow nature of this section facilitates their insertion. The track then widens out after this initial narrow section of the loading zone. The narrow nature of this section allows for horizontal insertion of the curtain, as opposed to the vertical insertion which is usually necessary. Further, the narrowness and horizontal insertion allow the track to be positioned higher up and closer to the ceiling, which further limits ring rotation. Likewise, the grabber, which is a device used to put up the curtain onto the track, can be simpler and less costly due to this loading zone which the curtain can be easily loaded onto.

Further embodiments of the invention will become apparent from the detailed disclosure of the invention and the figures provided herein.

BRIEF DESCRIPTION OF THE DRAWINGS

FIG. 15*b*-2 is a schematic of a front view of the component of FIG. 15*a*.

FIG. 15*b*-3 is a schematic of a side view of the component of FIG. 15*a*.

FIG. 16*b*-1 is a schematic of a top view of the component of FIG. 16*a*.

FIG. 16*b*-2 is a schematic of a side view of the component of FIG. 16*a*.

FIG. 16*b*-3 is a schematic of a front view of the component of FIG. 16*a*.

FIG. 17*b*-1 is a schematic of a side view of the component of FIG. 17*a*.

FIG. 17*b*-2 is a schematic of a front view of the component of FIG. 17*a*.

FIG. 18*b*-1 is a schematic of a top view of the component of FIG. 18*a*.

FIG. 18*b*-2 is a schematic of a cross-section of the component of FIG. 18*a* taken along the line A-A of FIG. 18*b*-1.

FIG. 18*b*-3 is a schematic of a front view of the component of FIG. 18*a*.

FIG. 19*b*-1 is a schematic of a side view of the component of FIG. 19*a*.

FIG. 19*b*-2 is a schematic of a top view of the component of FIG. 19*a*.

FIG. 19*b*-3 is a schematic of a detailed, rear view of the portion of the component of FIG. 19*a* that is labeled "A" in FIG. 19*b*-1.

FIG. 19*b*-4 is a schematic of a bottom view of the component of FIG. 19*a*.

FIG. 19*b*-5 is a schematic of a side view of the component of FIG. 19*a*.

FIG. 19*b*-6 is a schematic of a rear view of the component of FIG. 19*a*.

FIG. 19*b*-7 is a schematic of a detailed, front view of the portion of the component of FIG. 19*a* that is labeled "A" in FIG. 19*b*-5.

FIG. 19*b*-8 is a portion of the schematic of FIG. 19*b*-7.

FIG. 20*b*-1 is a schematic of a front view of the component of FIG. 20*a*.

FIG. 20*b*-2 is a schematic of a side view of the component of FIG. 20*a*.

FIG. 20*b*-3 is a schematic of a cross-section of the component of FIG. 20*a* taken along the line A-A of FIG. 20*b*-2.

FIG. 20*b*-4 is a schematic of a rear view of the component of FIG. 20*a*.

FIG. 21*b*-1 is a schematic of a side view of the component of FIG. 21*a*.

FIG. 21*b*-2 is a schematic of a rear view of the component of FIG. 21*a*.

FIGS. 22*b*-1 is a schematic of a top view of one embodiment of the component in FIG. 22*a*.

FIG. 22*b*-2 is a schematic of a side view of the embodiment of the component of FIG. 22*a*.

FIG. 22*b*-3 is a schematic of a top view of a further embodiment of the component of FIG. 22*a*.

FIG. 22*b*-4 is a schematic of a side view of the embodiment of the component of FIG. 22*b*-3.

DETAILED DESCRIPTION OF THE INVENTION AND THE PREFERRED EMBODIMENTS

Figure 1A:
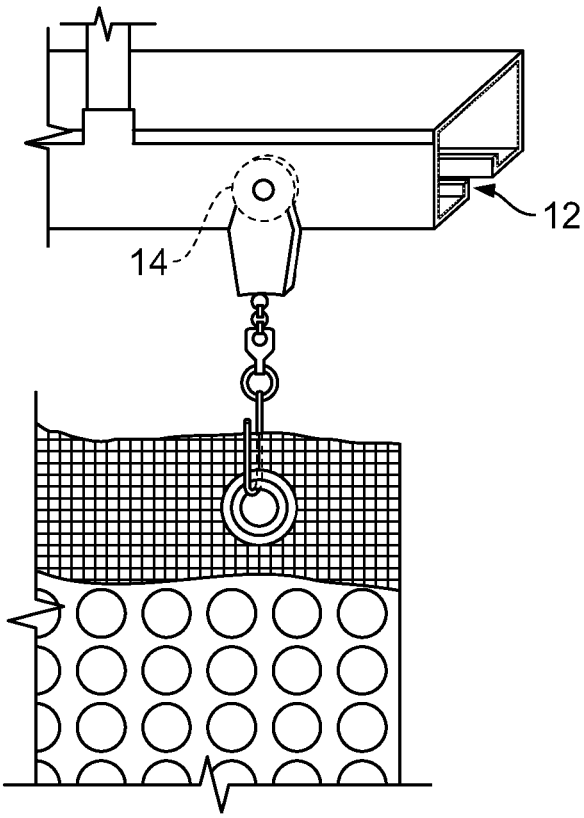
FIG. 1A (Prior Art)
FIGS. 1*a* and 1*b* are schematics of the prior art to the present invention.
Figure 1B:
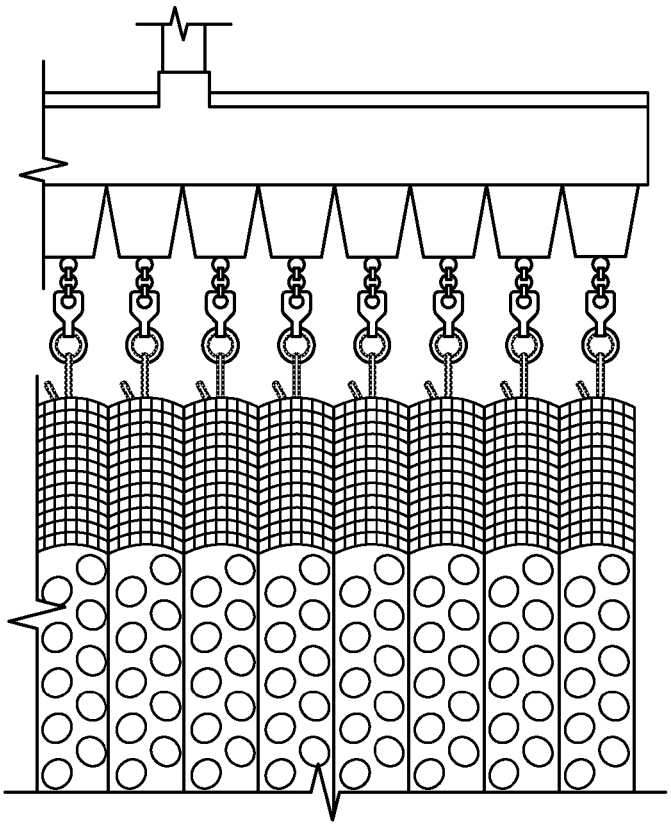
FIG. 1B (Prior Art)

In accordance with the invention, a modular system is provided for hanging an associated curtain. As shown in the figures, the modules of the system include a series of track sections, the track sections being configured as a combination of a rod and a track, with the benefits of both. The modular track sections are further configured for attachment to each other to adjust the length and shape of the track to suit any desired environment.

Like a rod, the top surface 938 of each modular track section is curved; thus, the openings of a curtain can hang from and slide along that top surface 938, as with the top surface of an ordinary (cylindrical) rod or tube. In particular, the top surface of each modular track section is preferably shaped as the upper portion of a rod or cylinder. Thus, a curtain with an opening therein or with rings 62 can be suspended from the track, such that the opening or rings slide or glide along that top surface. Examples of curtains having rings integrated therein which slides along a rod are disclosed for example, in U.S. Pat. Nos. 5,186,232; 6,494,248; 6,935,402; and 7,296,609; all of which are incorporated herein by reference.

Like a track, however, the modular track sections also include grooves therein, the grooves being provided in the side of one or more, or all, of the sections of the track. The grooves allow the attachment of accessory components which extend from the side of the track, and which can be used to attach the track to fixed supports in the environment.

In a preferred embodiment, the system is provided for use in hospitals and other health care facilities. However, the invention is not limited to health care contexts, but rather can be used in any environment where a room divider, privacy or an enclosed space is desirable or necessary, whether commercial, residential, military, or emergency contexts, or otherwise.

For example, in commercial settings, the inventions can be used in office cubicles, showrooms, trade shows, display booths, in stores (or store windows), among other uses. In residential settings, it can be used around a bed, or anywhere else desired in homes, dormitories, hotels, nursing homes, and so forth. In military and governmental settings, the invention can be used in military barracks and offices, whether permanent or temporary, and in prisons. In an emergency setting, the invention can be used with tents or temporary structures in the field, whether for hurricane or disaster relief, in hospital units (field hospitals), within temporary tents or structures (belonging to relief or aid workers or governmental personnel), or so forth. (In such temporary or makeshift contexts, the curtains can be affixed to tracks on the frame of the tent or structure, or to portable weighted stands, or so forth). For outdoor use, the inventions can be used around tennis courts, swimming pools, porches, terraces, and so forth. In general, the inventions can be used in any indoor or outdoor location desired.

As shown in FIGS. 2-5 and FIGS. 15-24, in accordance with the invention the modular track system consists of a series of components designed for adaptability to form a horizontal track which can be attached to fixed supports in any of numerous different environments. Preferably, each of the modular track sections are a combination of a rod and track (although they can include portions which are flat, round, solid and/or hollow, as desired). In the preferred embodiment, the track system is mounted directly to the fixed support, such as a wall, ceiling, column, stand, or so forth. Alternatively, the system can be mounted onto the track systems of the prior art, such as the existing tracks in hospitals as further discussed below, or to the frame of a tent, or a portable weighted stand as previously noted.

Figure 2:
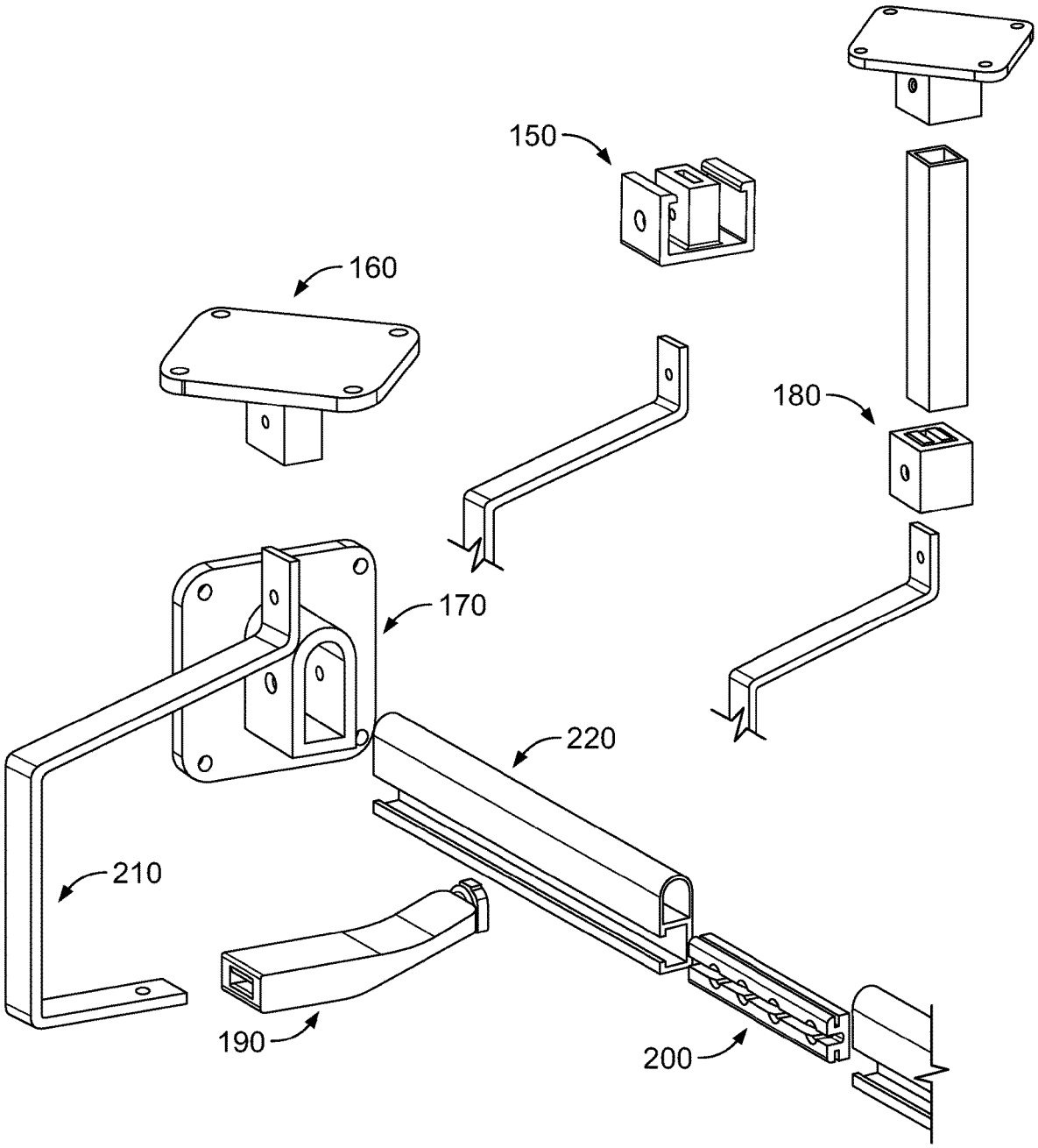
FIG. 2 is an exploded perspective view of the various components of a track system for hanging a curtain, in accordance with one embodiment of the present invention.
Figure 3:
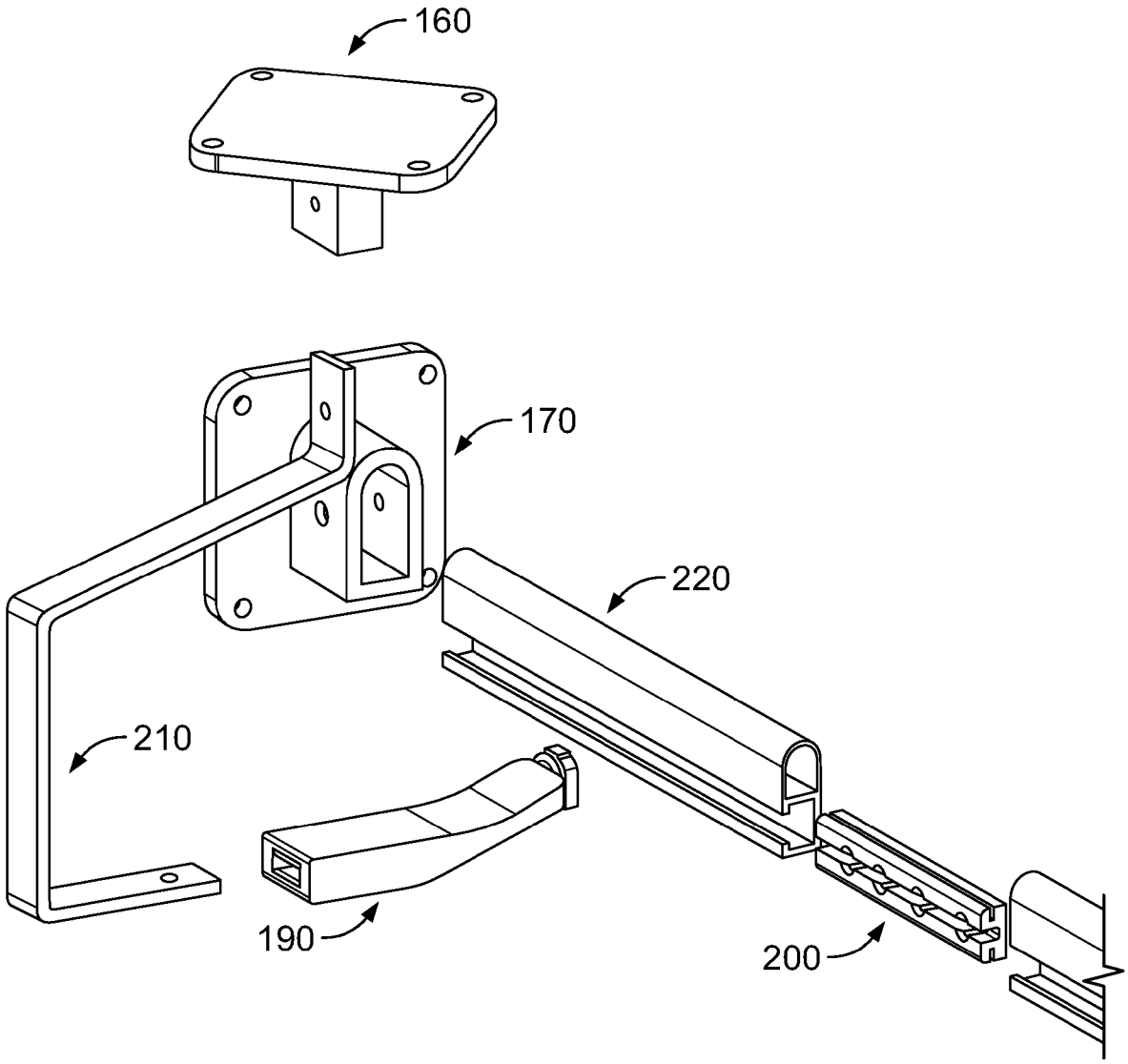
FIG. 3 is an exploded perspective view of the various components of a track system for hanging a curtain to a ceiling or wall, in accordance with one embodiment of the present invention.
Figure 4:
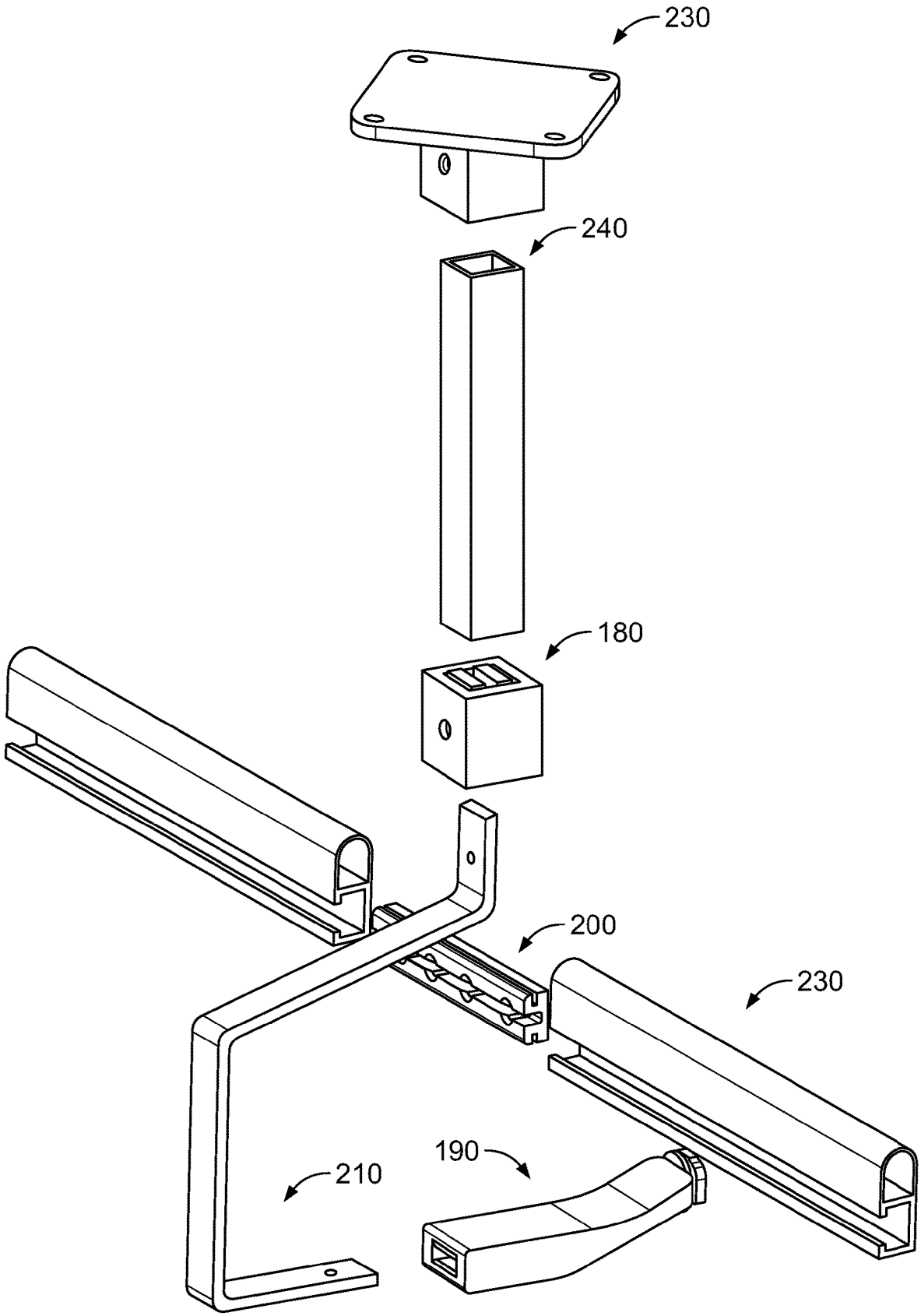
FIG. 4 is an exploded perspective view of a track system for hanging a curtain, in accordance with an embodiment of the present invention in which an extension and adapter can be used to lower the track, i.e. to increase the distance between the track and the ceiling.

In a new installation, when the track system is mounted directly to a wall or ceiling, a ceiling mount 160 and/or end cap 170 is used as shown in FIGS. 2, 3 and 4. Ceiling mount 160 (as further shown in FIGS. 16*a* and 16*b*) consists of a flat plate 162 on its top side, the flat plate preferably being screwed or otherwise adhered to the ceiling of the desired environment. End cap or wall mount 170 (as further shown in FIGS. 17*a* and 17*b*) likewise consists of a flat plate 172, the plate being on its side, and provided for screwing or adhering to a flat surface (whether a wall or otherwise). Alternatively, a curved plate can be used for attachment of the mount to a column.

Figure 17A:
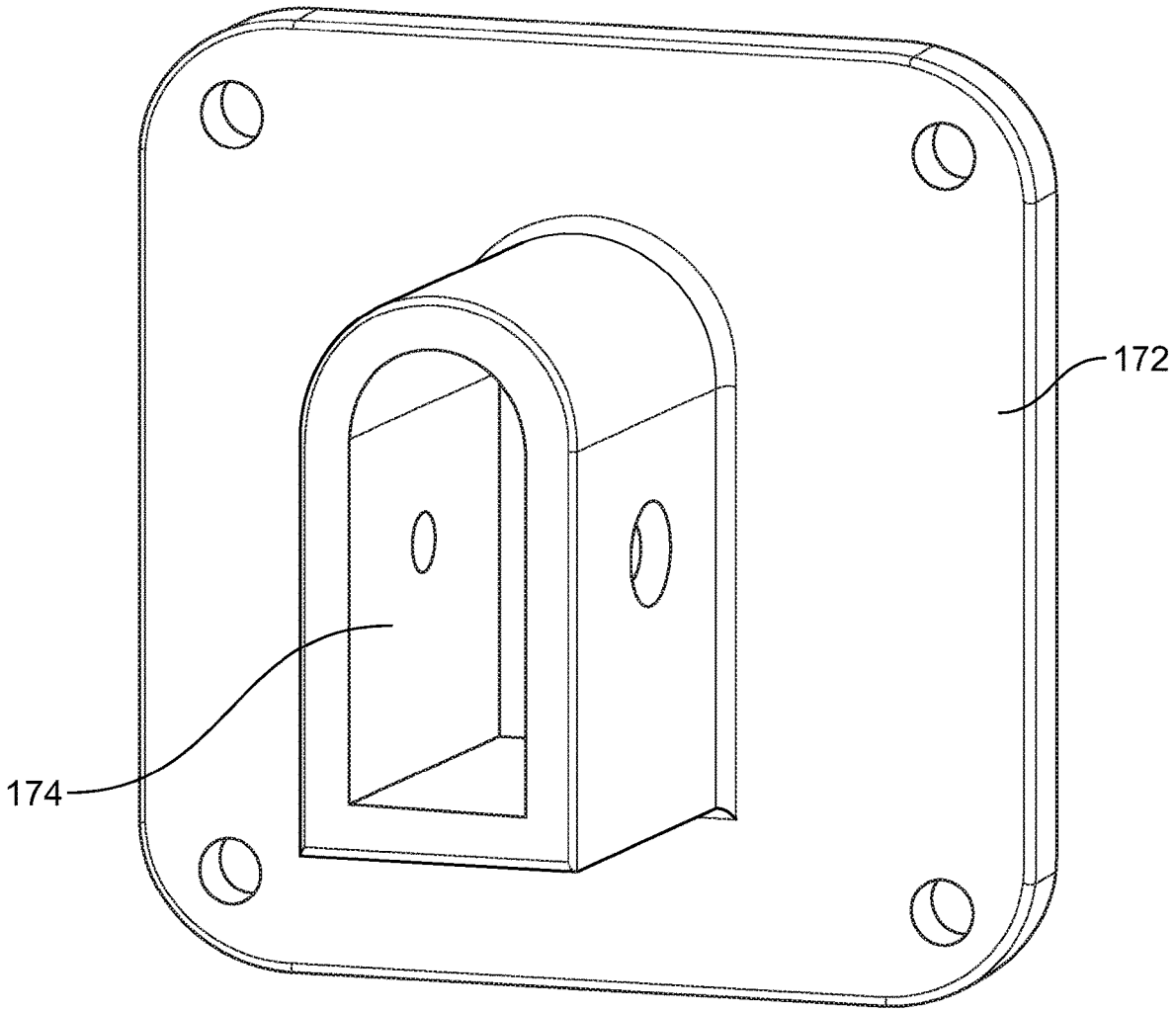
FIG. 17*a* is a perspective view of a further component of an embodiment of the track system of the present invention.
Figures 2, 17B:
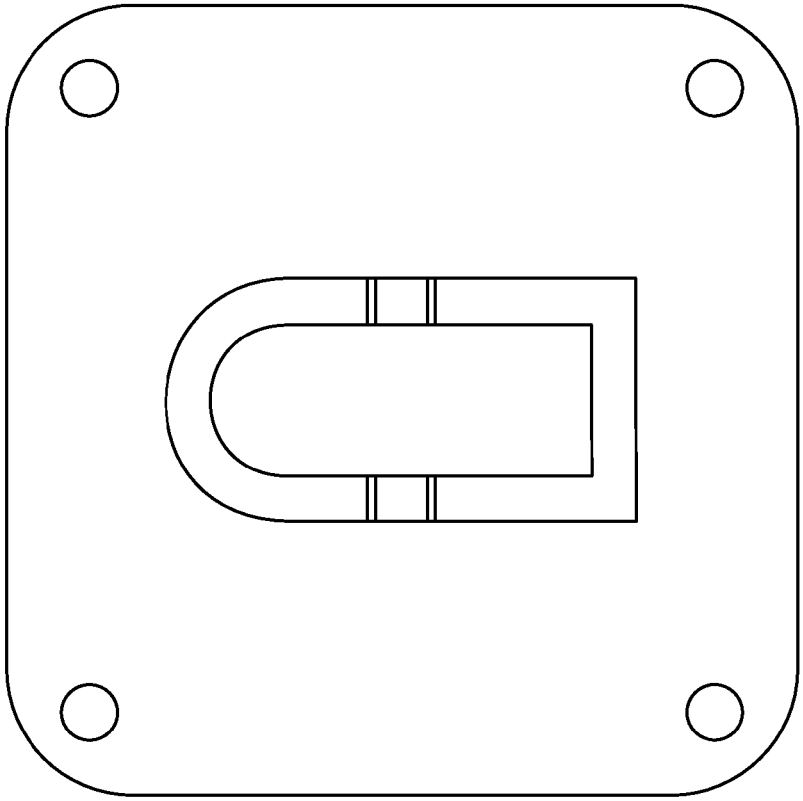
Figures 1, 17B:
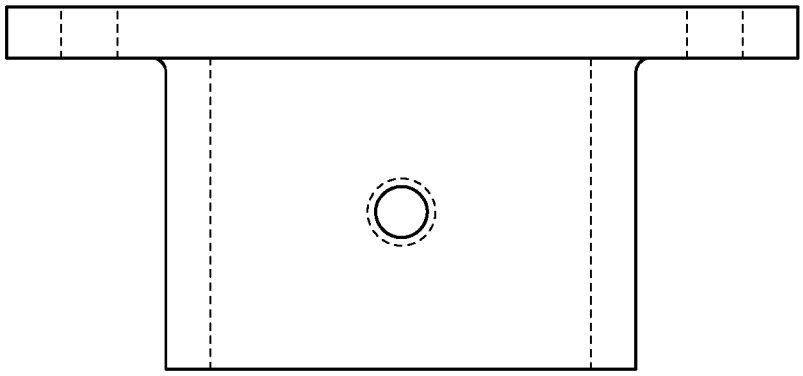
Figure 18A:
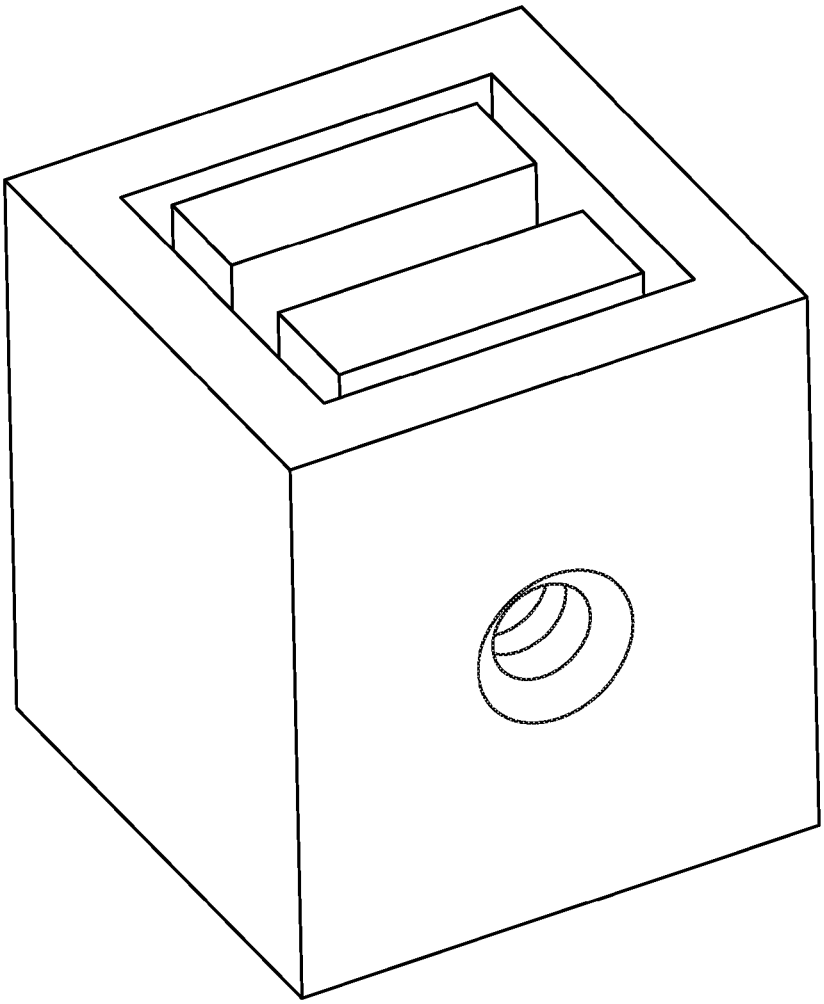
FIG. 18*a* is a perspective view of a further component of an embodiment of the track system of the present invention.
Figures 1, 18B:
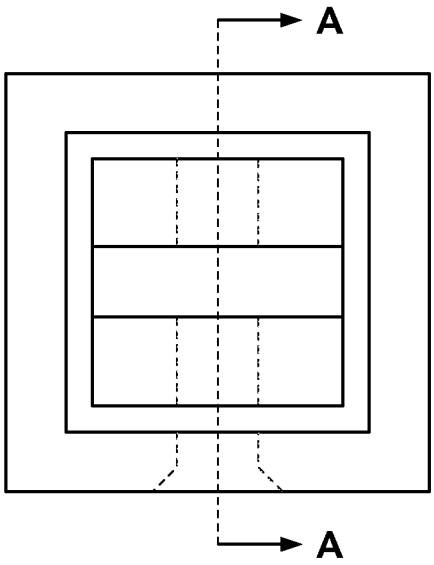
Figures 2, 18B:
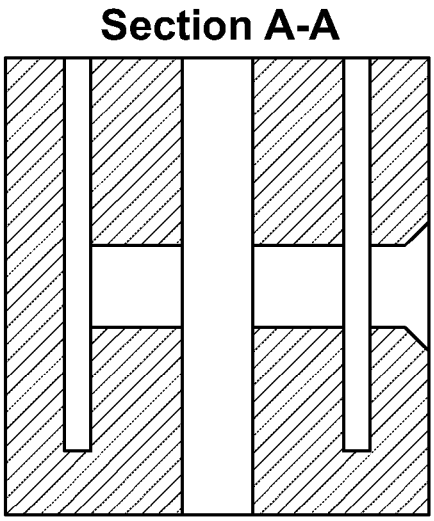
Figures 3, 18B:
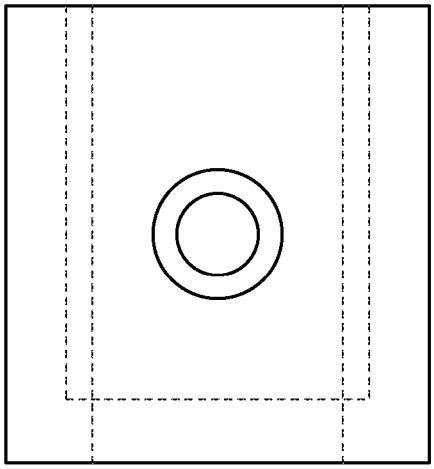
Figure 19A:
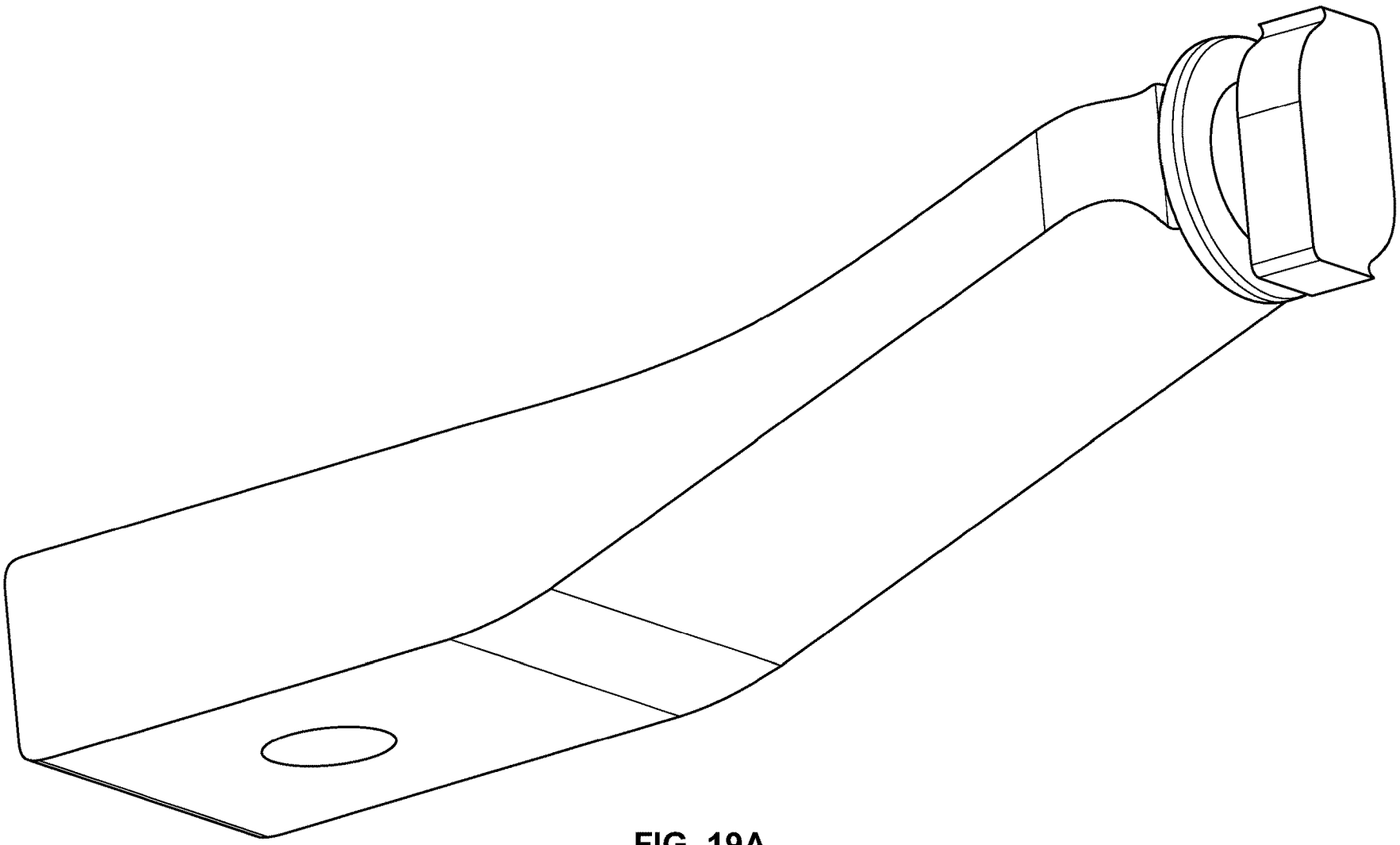
FIG. 19*a* is a perspective view of a further component of an embodiment of the track system of the present invention.
Figures 1, 19B:
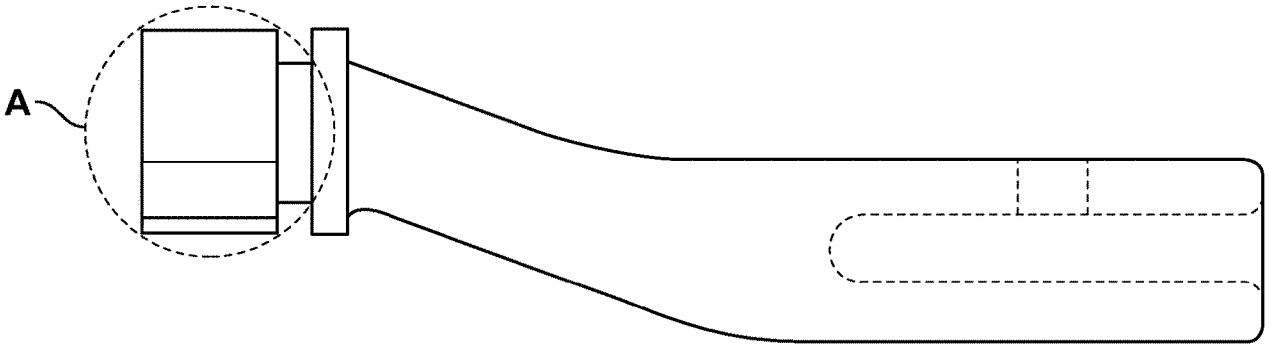
Figures 2, 19B:
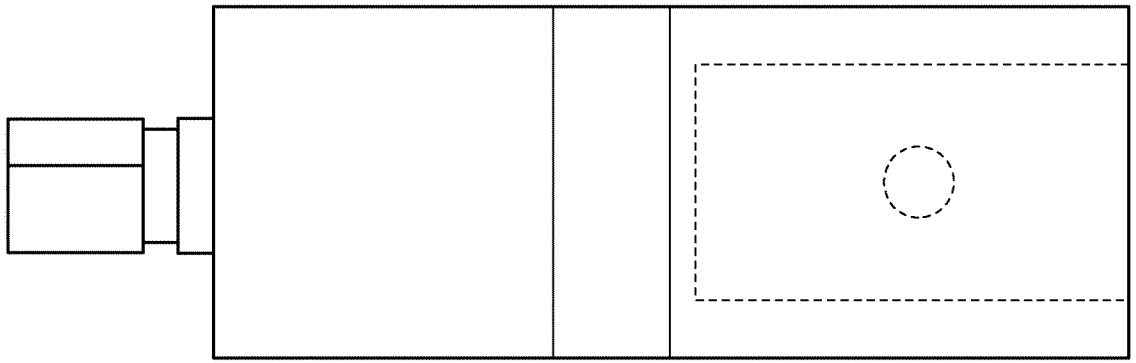
Figures 3, 19B:
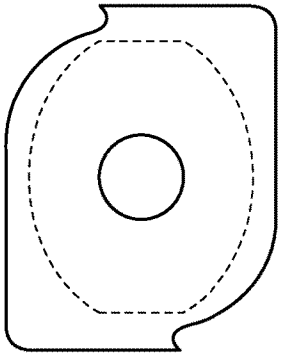
Figures 4, 19B:
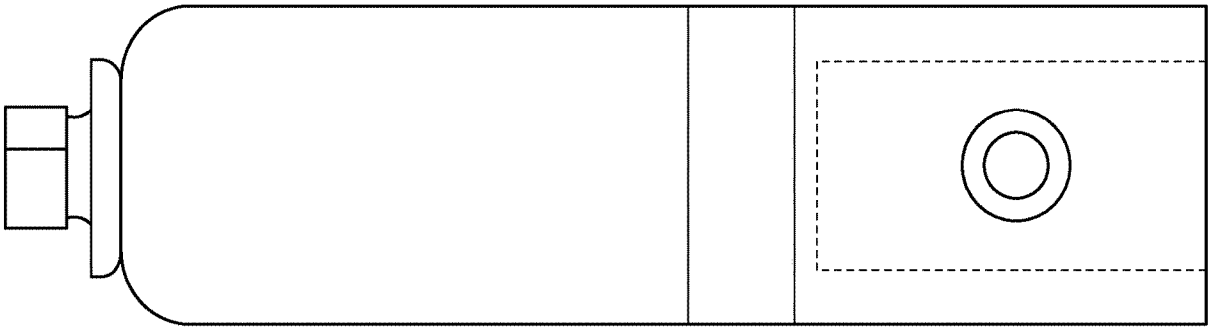
Figures 5, 19B:
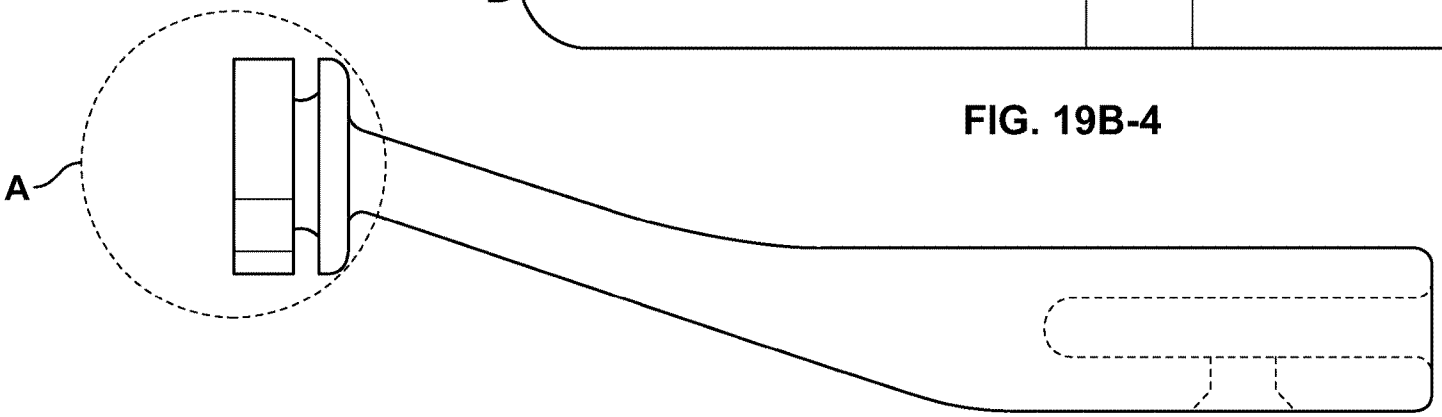
Figures 7, 19B:
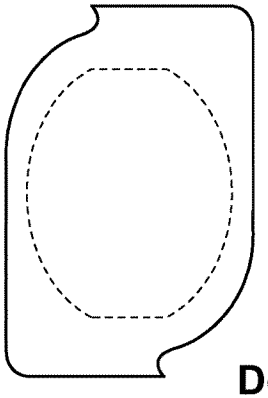
Figures 6, 19B:
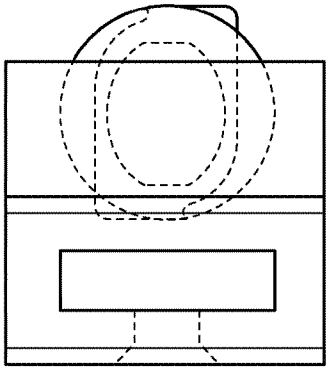
Figures 8, 19B:
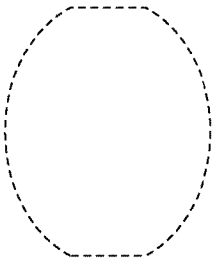
Figure 20A:
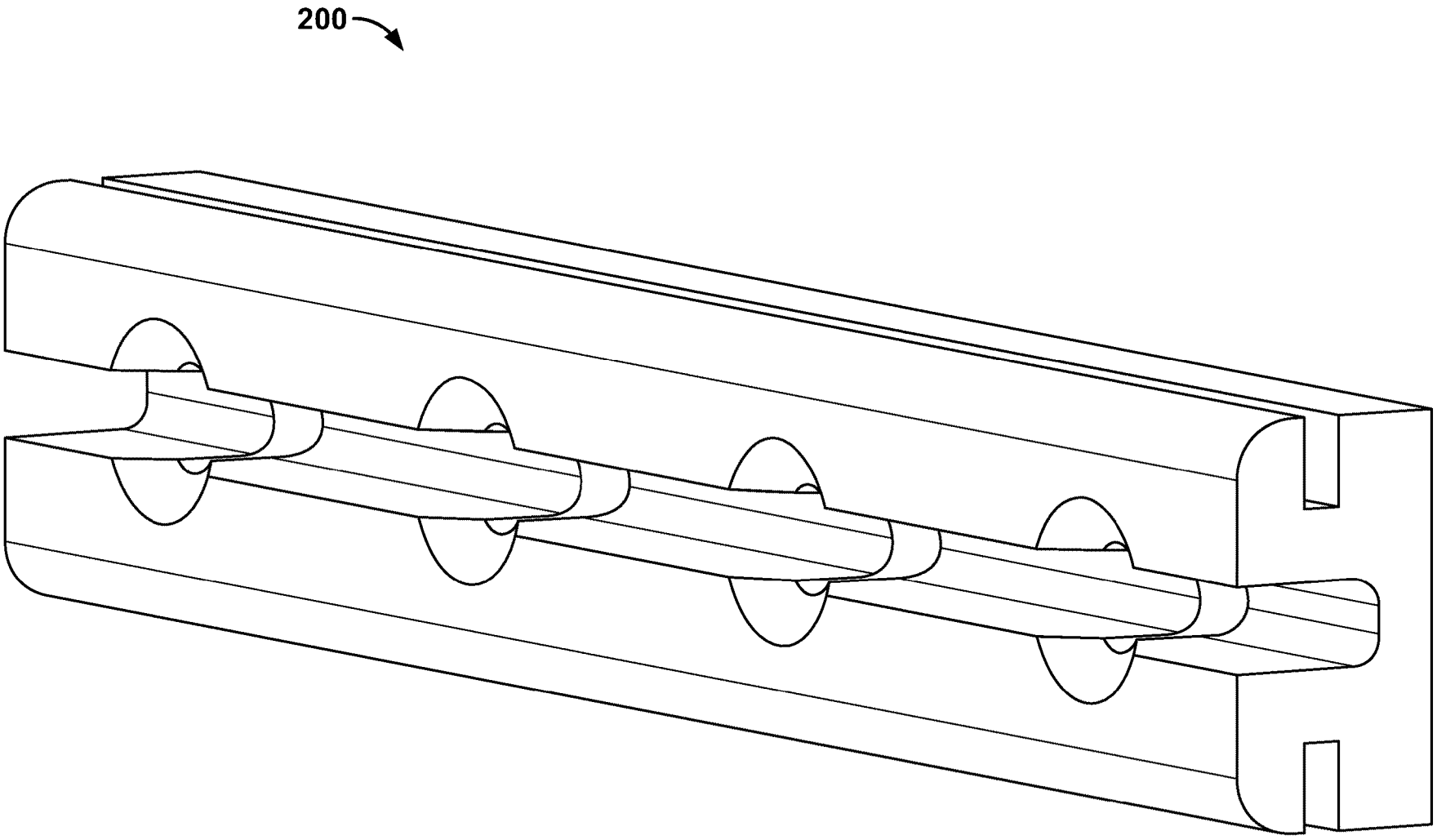
FIG. 20*a* is a perspective view of a further component of and embodiment of the track system of the present invention.
Figures 1, 20B:
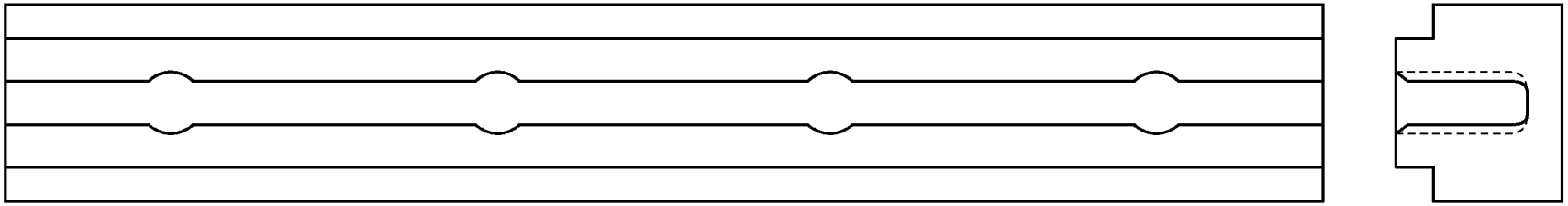
Figures 3, 20B:
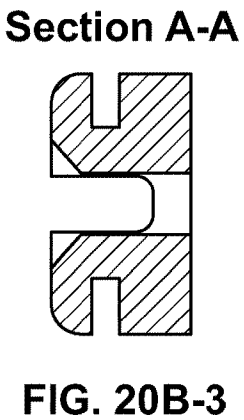
Figures 2, 20B:
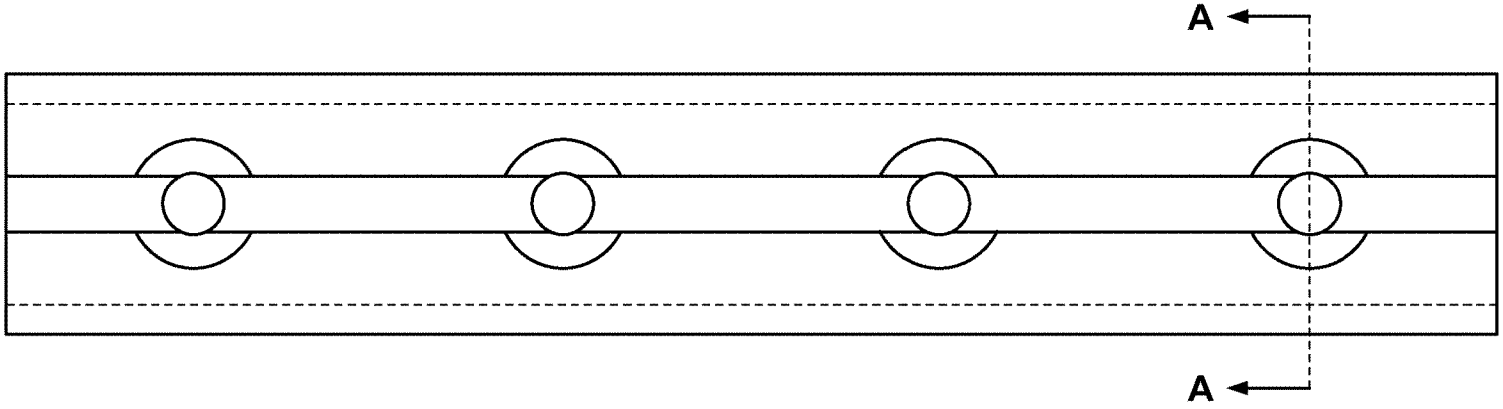
Figures 4, 20B:
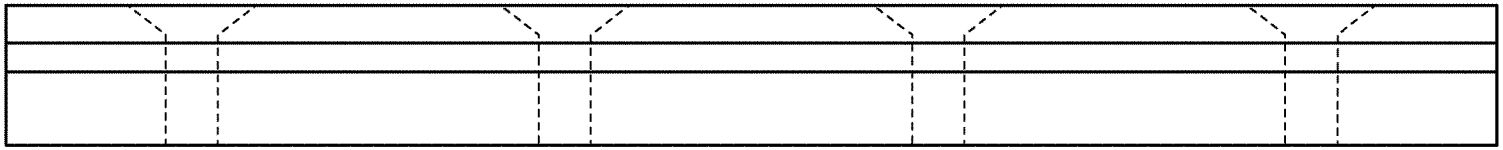

As shown in FIGS. 2 and 17, end cap 170 includes a socket 174 extending therefrom. Socket 174 of end cap 170 is used to attach the end cap to the rod or track 220. Preferably, screws are used to secure the track to the end cap (and likewise to attach other components together as shown in the figures). In one preferred embodiment, the cross section of socket 174 is a four sided polygon with three straight and one curved side, to correspond to one of the preferred embodiments of a track for insertion therein.

Ceiling mount 160 likewise includes a socket 164 extending therefrom, as shown in FIGS. 2 and 16. Socket 164 of ceiling mount 160 can be used for attaching the ceiling mount to vertical mount 210. Alternatively, if a lower track is desired (i.e. a track which hangs farther from the ceiling), extension 240 can be used, as shown in FIG. 4. As shown in that figure, in that embodiment a ceiling mount 230 is attached to the extension 240, which attaches to adapter or socket 180, which in turn is attached to vertical mount 210. Due to the desired length of extension 240 (up to approximately 24 inches), a hollow tube construction is used for that extension to provide torsional stability (with adapter 180 being used to mate vertical mount 210 with extension 240).

In a preferred embodiment, the track includes a side support, with one end of the side support being attached to the track and the other being attached to a fixed support, whether directly or through another component. Thus, the side support can be a side mount, or a vertical mount, or the combination of a side mount and vertical mount. Whether the side mount and/or vertical mount are used individually or in combination, they act as side supports to attach a side of the track to a fixed support. Thus, a side mount can be attached to a side of the track on one end, with the side mount extending parallel or approximately parallel to the ground, and having a second end for attachment to a vertical fixed support, such as a column (such as the column of a building), or a stand (such as the stand of a movable support for use at a trade show). Or, the vertical mount can be used to attach the track to a horizontal fixed support, such as a ceiling or other overhead support. For example, one end of the vertical mount 210 can be attached to the side of a track section 220, to act as a side support secured to the track, with the other end extending toward the ceiling to suspend the side of the track from the ceiling. The vertical mount 210 can be attached directly to the side of the track or through a side mount 210; if attached directly to the side, the vertical mount and side mount can be integrated into a single unit.

In the preferred embodiment, the bottom of vertical mount 210 is attached to one end of side mount 190. For example, the end 218 of vertical mount 210 can be inserted into and screwed to a socket 192 at the end of the side mount 190. The other end of side mount 190 is attached to the length of track, by attaching it to a side of the track section 220. Since the vertical mount is curved or C-shaped, or the combination of the vertical mount and side mount forms a curve or C-shape, the attachment form a curved or approximately C-shaped connection between the ceiling and the track, as shown in FIGS. 3-4.

Various connections can be made between the side mount and the track section 220. For example, in one embodiment, side mount 190 includes an end piece 194 (shown in FIGS. 19*a-b*) which is configured for insertion into the groove 222 of track 220 (shown in FIG. 22*a*) and/or groove 930 of FIG. 25. Preferably groove 222 is horizontal, although a vertical groove can alternatively be provided if desired. In a further embodiment of the invention, a twist lock mechanism is provided for a side mount 195, as shown in FIG. 26. In accordance with this mechanism, side mount 195 is inserted into the groove of the track and then rotated to affix it in place. Width (Wb) of the end of component 195 is less than the height (Hg) of the groove in the track component, whereas height (Hb) of the end of side mount 195 is equal to (or slightly greater than) the height (Hg) of the groove. Accordingly, the side mount is initially inserted with the end sideways such that width Wb is oriented along the height of the groove, with the component sliding easily (due to its small width). Once the side mount is at the correct spot along the track, the component is rotated 90 degrees so that the side mount 195 is wedged tightly in place, due to height Hb being equal to the height Hg of the groove (or slightly greater in height if the material of the component is slightly flexible).

In an alternative embodiment, there is a flap 1002 (FIG. 36), to cover the slit between the rings. The flap can be attached to the top of the opening. The flap can hang on either the front or back of the curtain, or alternatively on both the front and back of the curtain. The bottom of the flap 1002 is made looser so that it can slide over the track as the curtain is being installed or while the curtain is moving along the track. The flap blocks light from passing through the curtain and bothering a patient in a bed on the other side of the curtain.

The track is preferably provided in track sections 220, wherein individual sections can be attached together to reach any length desired using couplers 200. Each side of coupler 200 slides into the groove 222 of a track section 220 to connect together the two track sections, as shown in FIGS. 3 and 4. Any number of track sections 220, whether two, three, five, ten, twenty or more, can be attached together to form any length of track desired. In addition, each section 220 of the track can be linear or curved, and each coupler 200 can likewise be linear or curved, to achieve any configuration desired and surround any shaped space regardless of the environment.

Figure 35:
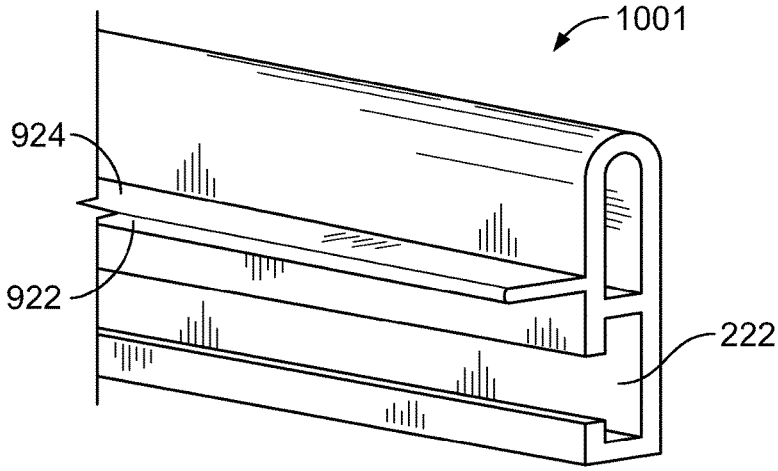
FIG. 35 is a perspective view of the component of FIG. 35.

In an alternative embodiment, there is a continuous track which is made of one track section that extends through the length of the track. The continuous guiderail 922 is positioned higher up than the preferred embodiment, above the side support. This positioning, as seen in FIG. 35, allows for better interface between the guiderail and the inward facing finger-like extension protruding from the mouth of the ring. This would further stabilize the curtain as the guiderail would block rotation of the ring due to its interaction with the inward-facing finger-like extension. It would block the ring from being able to rotate and reach the 12 o'clock position, a position which would cause the ring to become detached from the track.

Thus, in a new installation the various components of the invention fit together in relative relationship as shown by the exploded view of FIG. 3. If desired, extension 240 and adapter 180 can be used to lower the track as shown by the exploded view of FIG. 4.

In a further embodiment of the invention, the modular system of the invention can be attached to an existing track system, e.g., a pre-existing track system already mounted in a hospital room. In this embodiment, shown in the exploded view of FIG. 5, track mount 150 is used (shown in FIGS. 15*a* and 15*b*). Track mount 150 attaches to the existing track of the prior art by sliding prong 152 into groove 12 of that existing track (shown in FIG. 1) where the prior art rollers 14 would normally slide. As many track mounts 150 as desired or needed can be attached to the pre-existing track.

Figure 5:
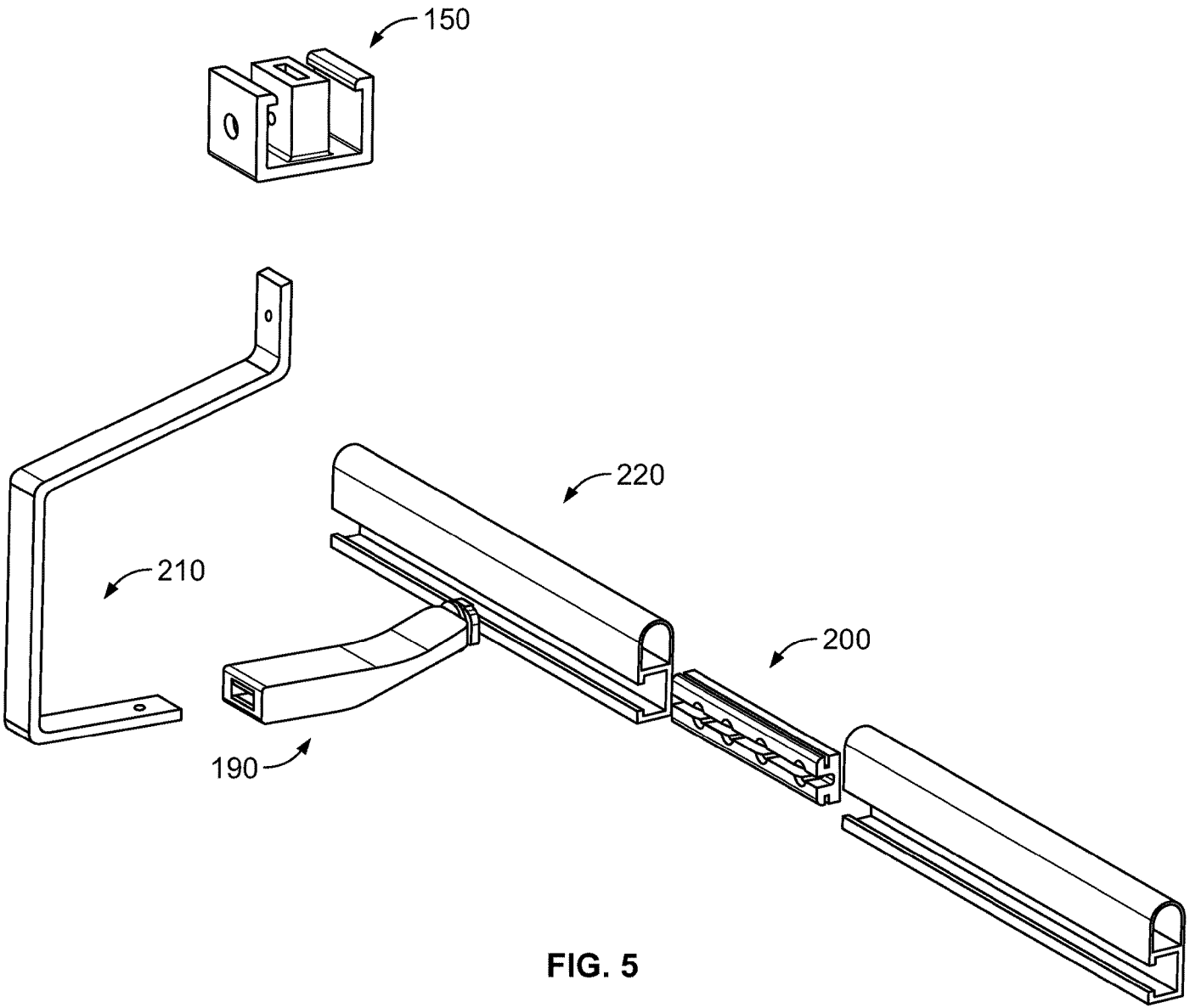
FIG. 5 is an exploded perspective view of a further embodiment of the invention in which a track mount is used, which attaches to the existing tracks of the prior art.
Figure 6:
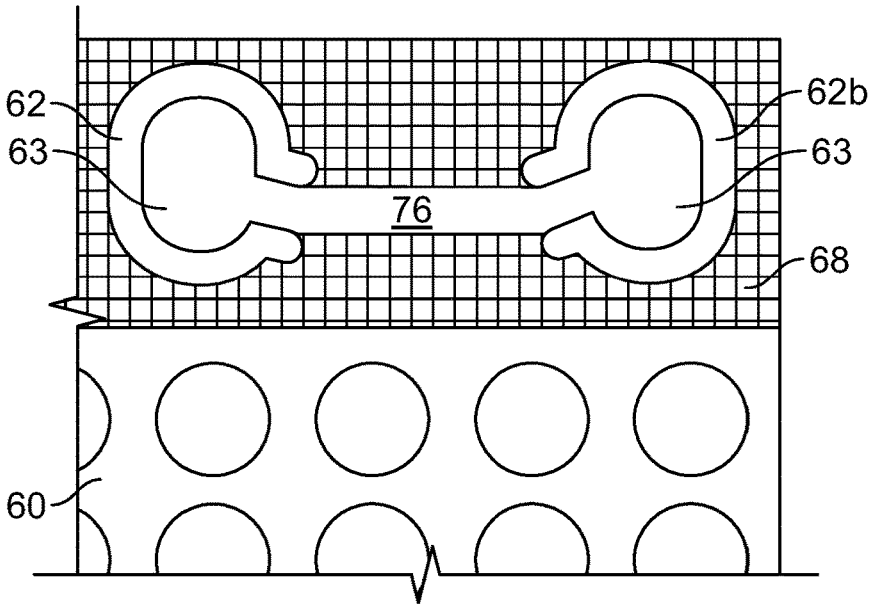
FIG. 6 is a front view of a curtain for use with the track system of the present invention.

Once the track mount has been inserted into the pre-existing track, vertical mount 210 is then attached to the track mount. Vertical mount 210 is attached to side mount 190 as shown, with the remainder of the component attachments being conducted as in a new installation. An exploded view showing the relative positions of the components during installation to an existing track is shown in FIG. 5. (Although the existing track is not shown in that figure, it will be understood that track mount 150 slides into a groove 12 of the existing track, such as shown in FIG. 1*a*).

Accordingly, consistent with the invention, a track system of modular construction and design is provided which can span unlimited lengths, as long as there is a secure wall, ceiling or pole to attach it to. The system is adaptable to a large variety of shapes to conform to any shaped area. The specially designed components of the system allow the track to be attached to ceilings, dropped ceilings, walls, existing cubicle tracks and even free standing columns (by using the end caps having a curved plate), allowing use in a wide variety of applications. Additionally, the system includes intermediate attachments fixed to a ceiling along the length of the track to support the weight of the curtain for longer lengths.

Figure 7:
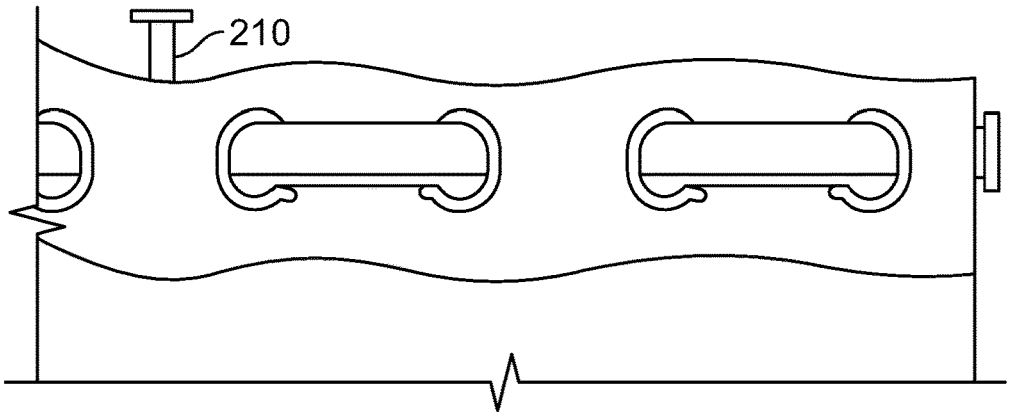
FIG. 7 is a front view of one embodiment of a curtain and track system of the current invention, wherein the curtain is attached to the track.
Figure 8:
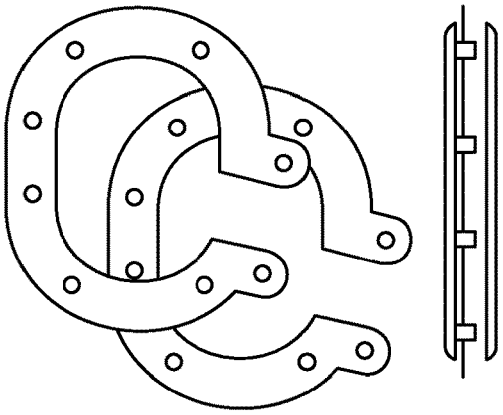
FIG. 8 is a front view and side view of an embodiment of a ring for use with the curtains of FIGS. 6 and 7.
Figure 9:
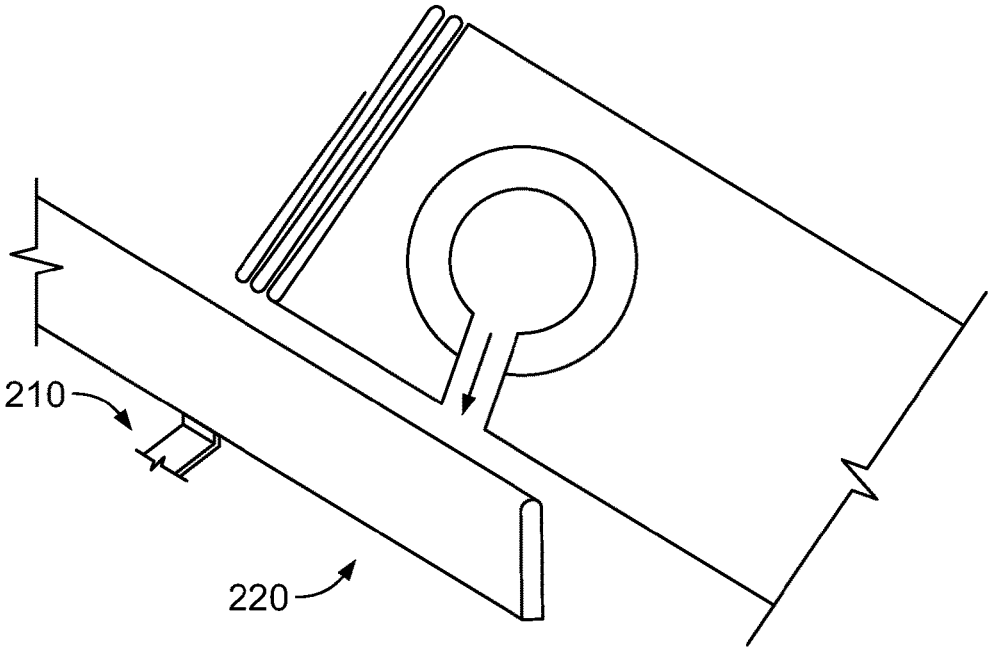
FIG. 9 is a perspective view of one embodiment of the present invention, wherein a series of wide mouth rings of the curtain are inserted over a section of the track in a single motion. (In addition, the rings do not need to flex in this embodiment, due to the sizing of the mouth of the ring and track).
Figure 10:
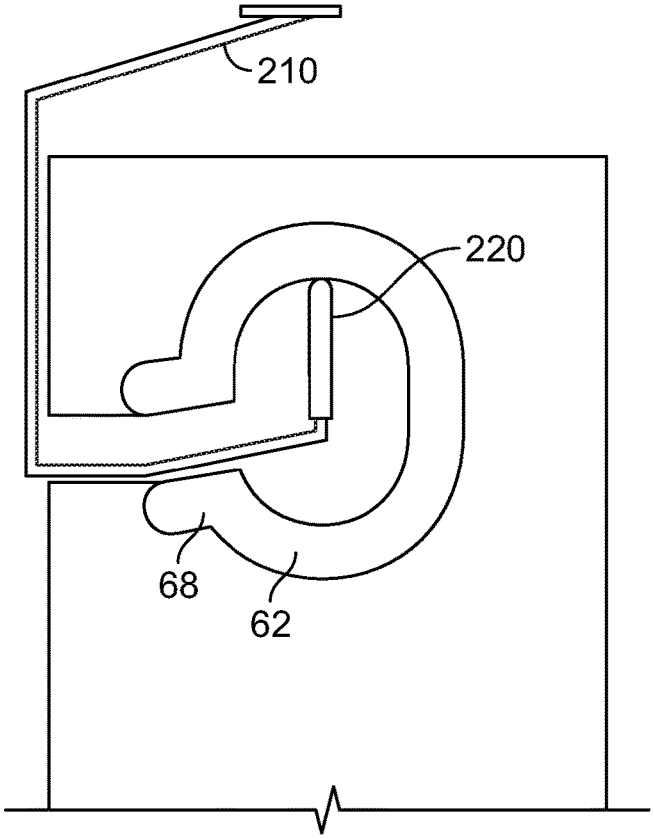
FIG. 10 is a perspective view of one embodiment of the present invention, wherein the ring of the curtain sits on the track with the top of the inner circumference of the ring hanging from (e.g. resting or balancing on) the top of the track section, the mouth of the ring being angled, sized and positioned to glide over a vertical support and side mount, the mouth of the ring having fingers to simplify and assist with insertion of the curtain ring onto the track.

These modular track configurations of the invention are designed for use with a curtain 60 having a series of integrated rings 62 therein, as shown in FIGS. 6-14. In preferred embodiments, rings 62 are circular or oval in shape. These rings form opposed pairs 62*a* and 62*b* that are designed to fit over track 220 as shown in FIGS. 7, 9 and 10. The rings 62 are related to those disclosed in U.S. Pat. No. 5,186,232, as preferably modified by the disclosures of U.S. Pat. Nos. 6,494,248; 6,935,402; and 7,296,609; and as further modified by the additional disclosure herein, with all of those prior patents being incorporated herein by reference.

As shown in FIG. 10, ring 62 balances on track section or rod 220, with the rings sliding along the top surface of the track 220 during use. Vertical support 210 is used to position the track within the openings 63 of rings 62. Thus, rings 62, track 230, and vertical support 210 are mutually configured to cooperate and to allow the curtain to slide easily along the track. At the same time, they are also designed to allow easy insertion and removal of the curtain onto and off of the track.

Figure 38:
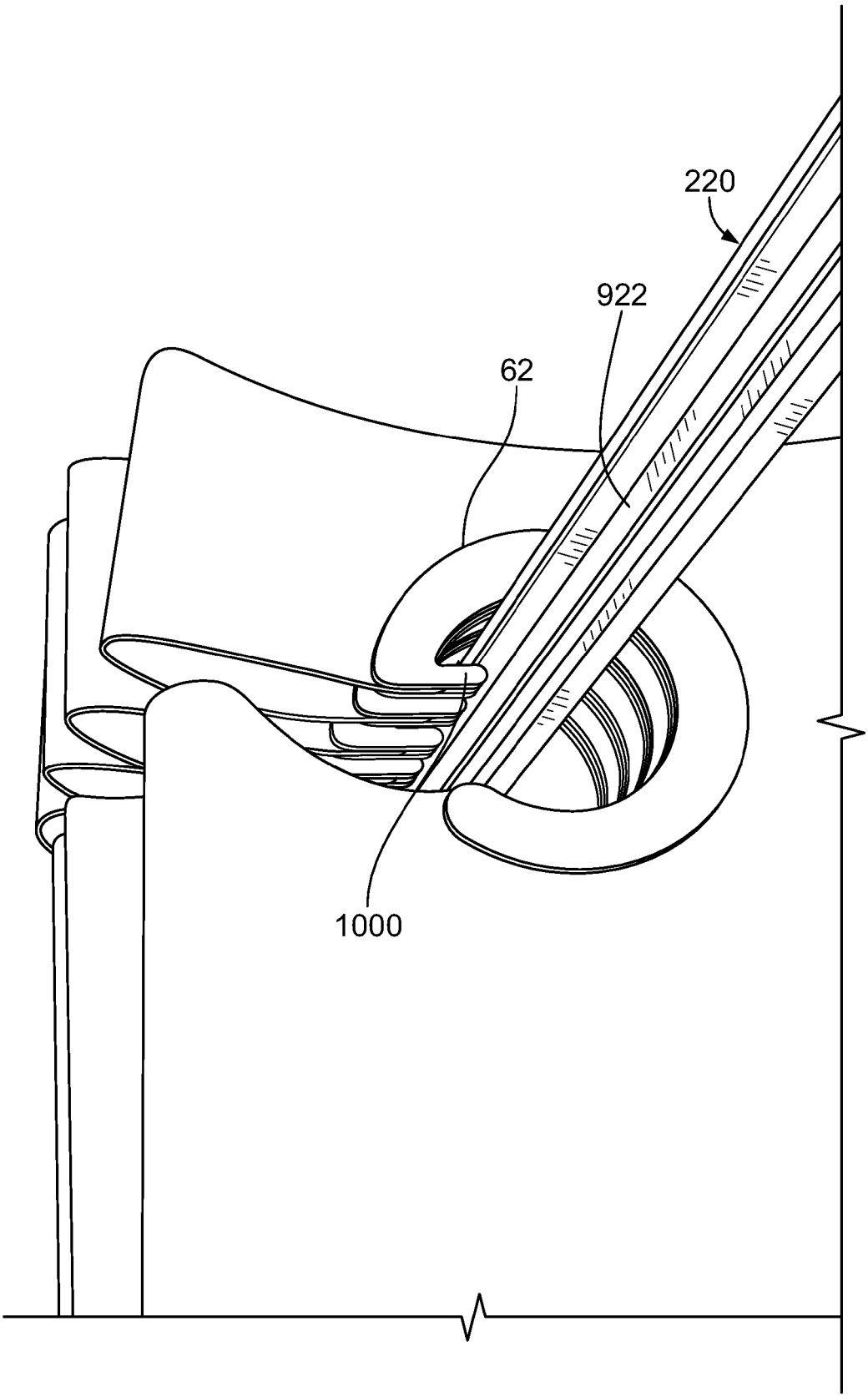
FIG. 38 is a further perspective view of a curtain including the ring-slit mechanism of FIG. 37.
Figure 39:
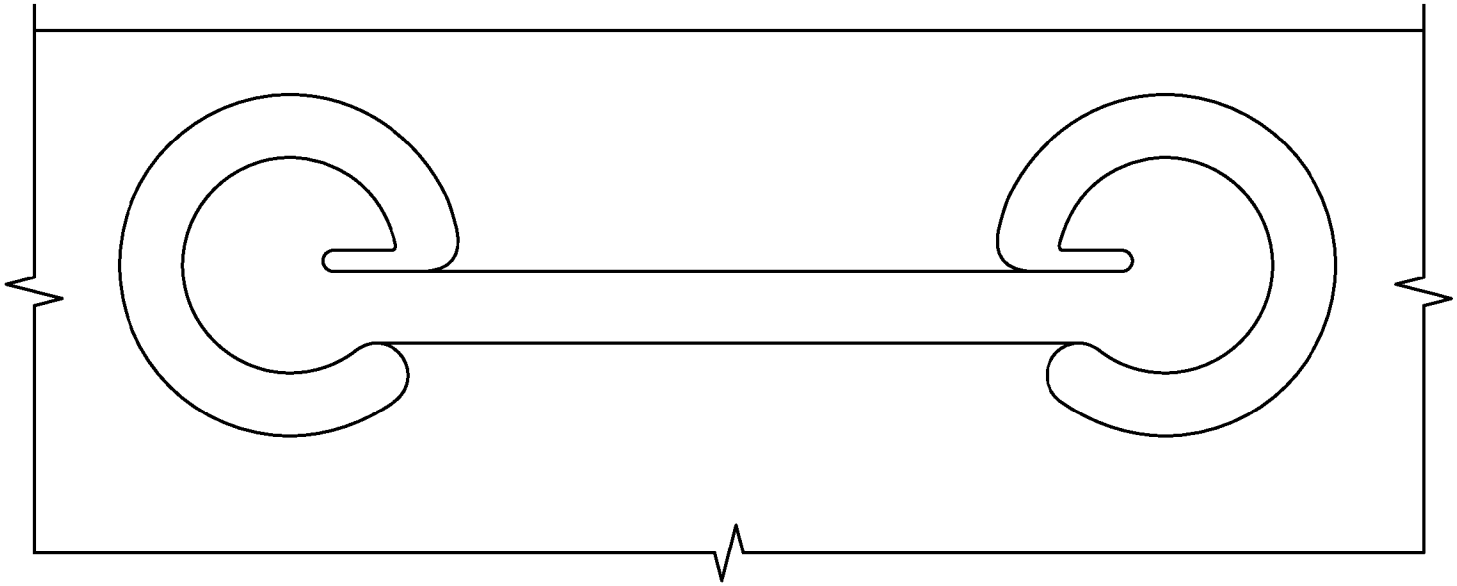
FIG. 39 is a front view of a curtain including a single ring-slit mechanism embodiment.
Figure 40:
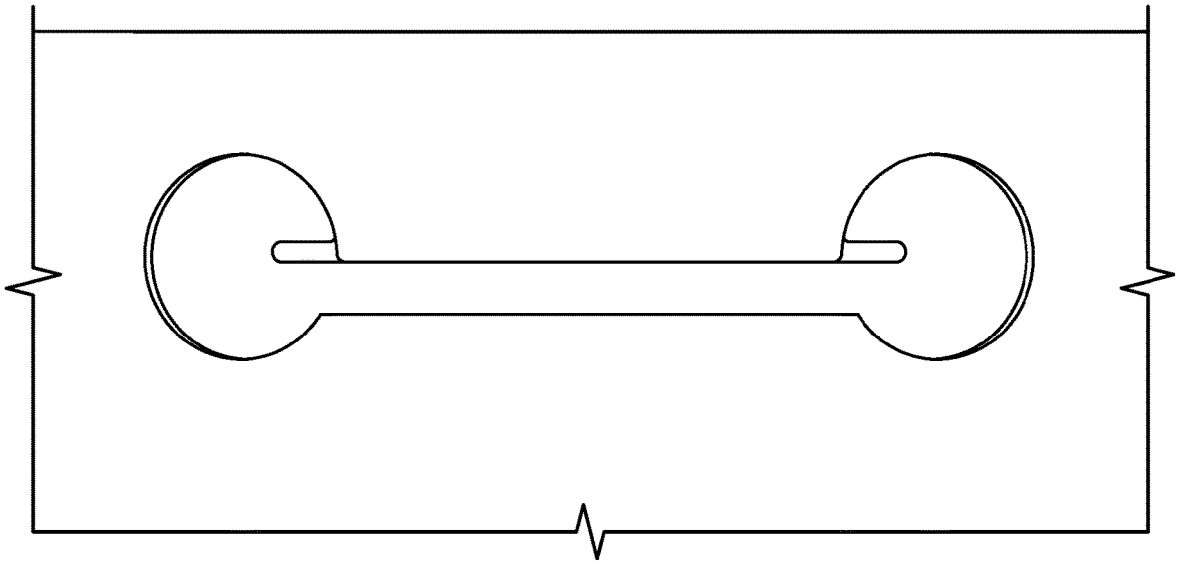
FIG. 40 is a back view of the curtain with ring-slit mechanism of FIG. 39.
Figure 41:
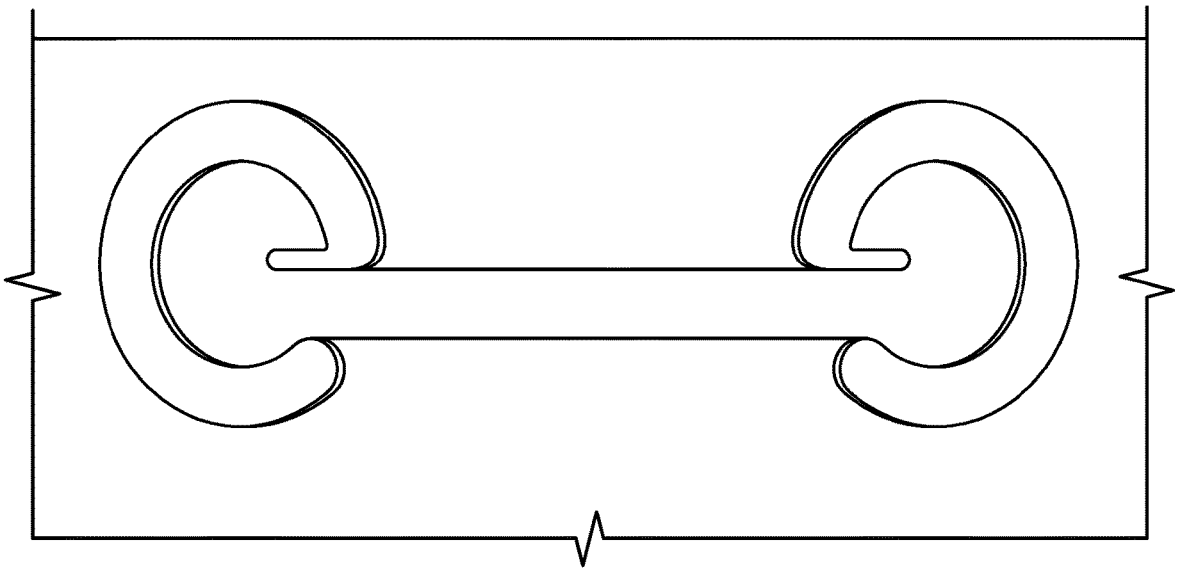
FIG. 41 is a further front view of a curtain with a ring-slit mechanism consistent with the present invention, showing the rings in a flexed position.
Figure 43:
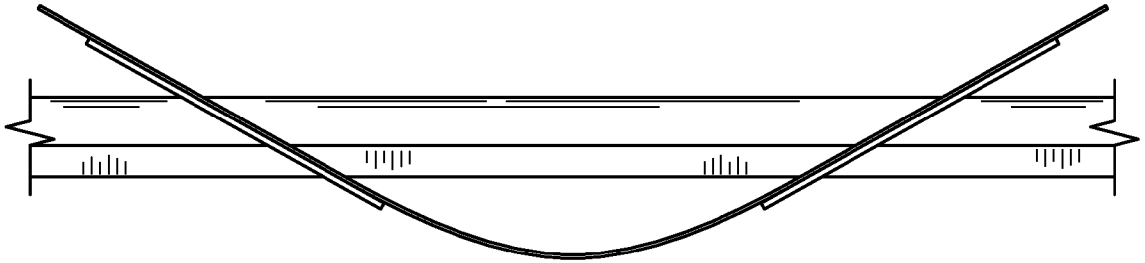
FIG. 43 is a perspective top view of the component of FIG. 39, wherein the curtain is resting on the track.
Figure 44:
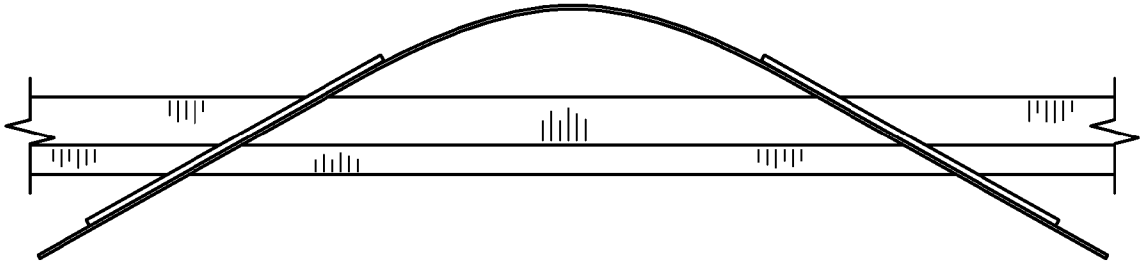
FIG. 44 is a perspective bottom view of the component of FIG. 39, wherein the curtain is resting on the track.
Figure 42:
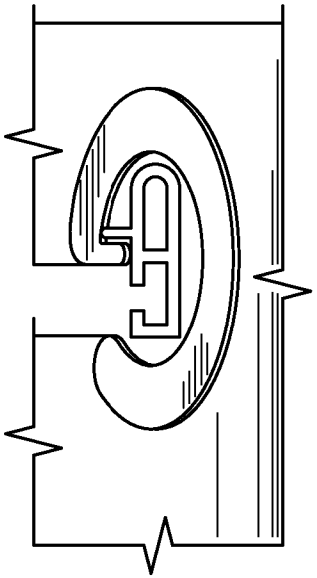
FIG. 42 is a perspective back view of the component of FIG. 41 showing the curtain and ring in use with a track system consistent with the present invention.
Figure 45:
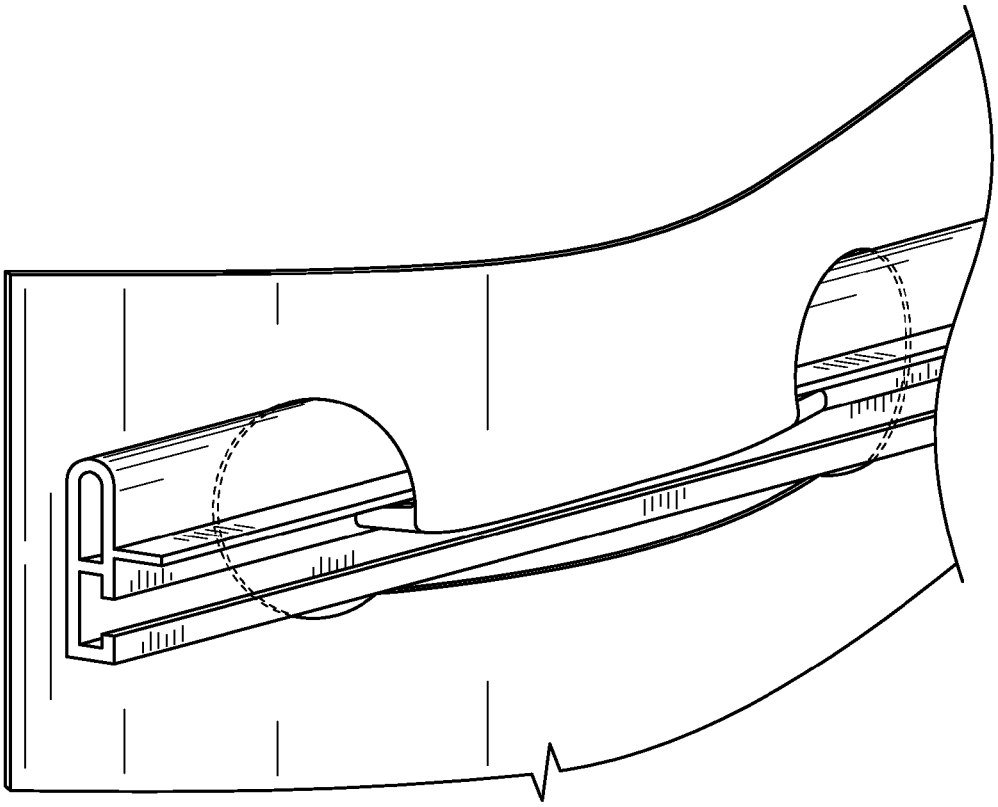
FIG. 45 is a further perspective back view of the curtain of FIG. 39 coupled with a track system consistent with the present invention.
Figure 46:
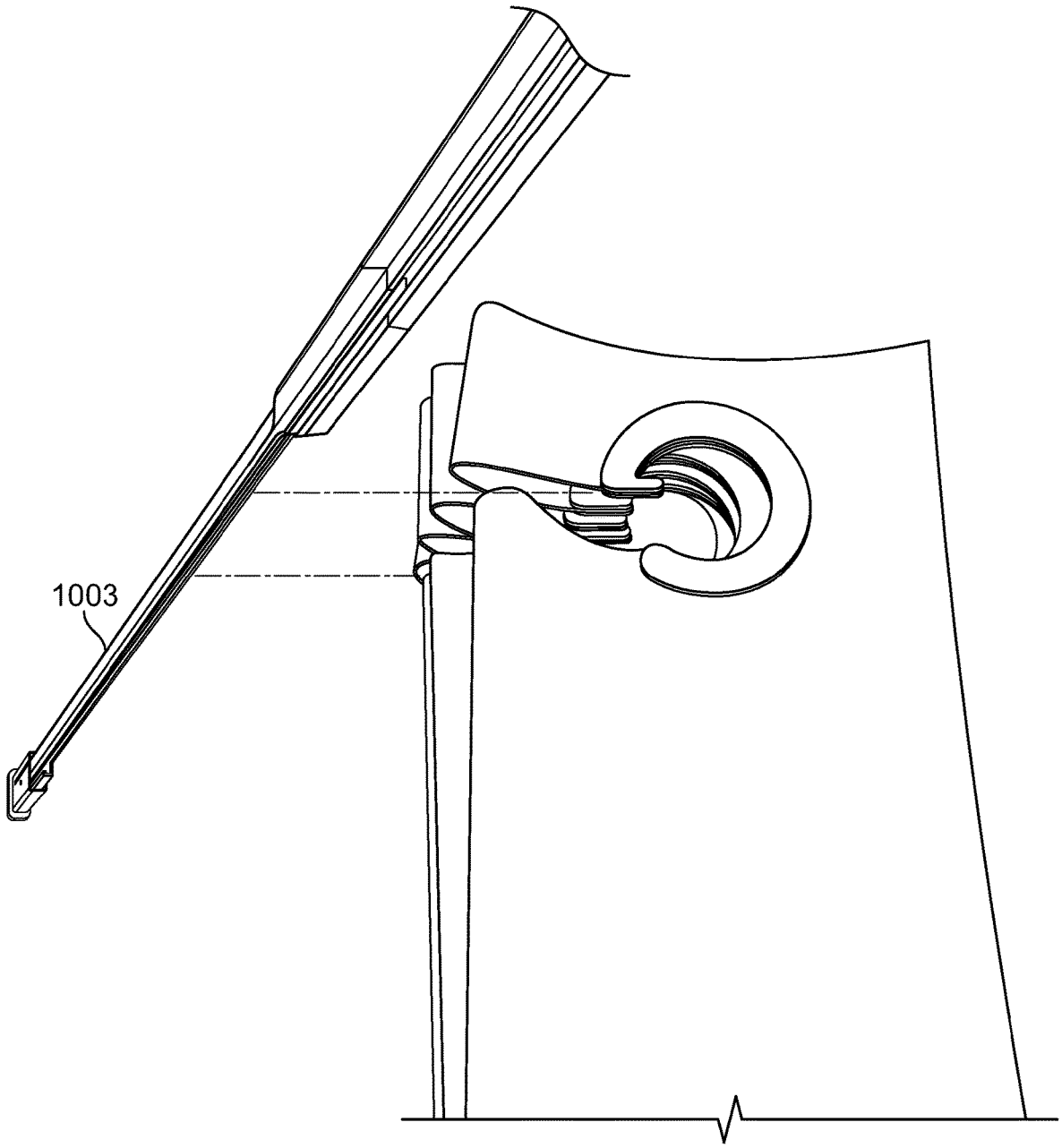
FIG. 46 is a perspective schematic representation of a curtain, including a double ring-slit mechanism, being loaded onto the loading zone portion of a track consistent with the present invention.

As shown in FIG. 38, double ring 62 balances on track 220, with the rings sliding along track 220 during use. Thus, rings allow the curtain to slide easily along the track. (By the term "double ring" is meant that each ring in this embodiment of the present invention consists of two rings that interface the curtain on both sides of the curtain, effectively sandwiching the curtain between the double ring. In contrast, a single ring embodiment of the present invention (FIGS. 39-40, e.g). interfaces the curtain on one side of the curtain only.) The inward facing finger-like extension 1000 protruding from the mouth of the ring interacts with the guiderail 922 of the track to provide further stability. The guiderail 922 blocks the rotation of the curtain rings as it interacts with the inward facing finger-like extension 1000 while the curtain slides across the length of the track. This is designed to prevent the rings of the curtain from coming off of the track.

Figure 27:
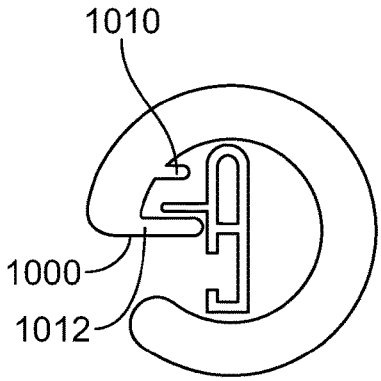
FIG. 27 is a front view of an embodiment of a ring of the present invention for use with curtains consistent with the present invention. The ring is shown mounted on a cross-sectional view of an embodiment of a track of the present invention.
Figure 28:
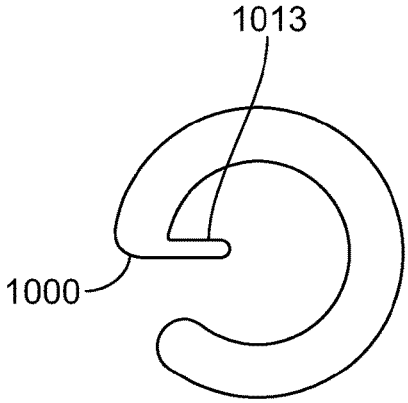
FIG. 28 is a front view of a further embodiment of a ring of the present invention for use with curtains consistent with the present invention.
Figure 29:
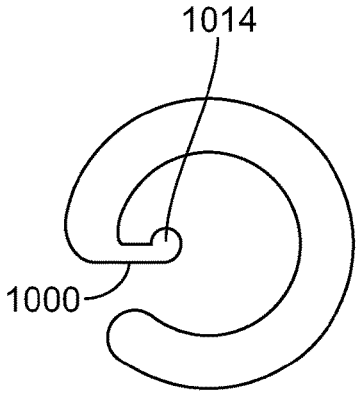
FIG. 29 is a front view of a further embodiment of a ring of the present invention for use with curtains consistent with the present invention.
Figure 30:
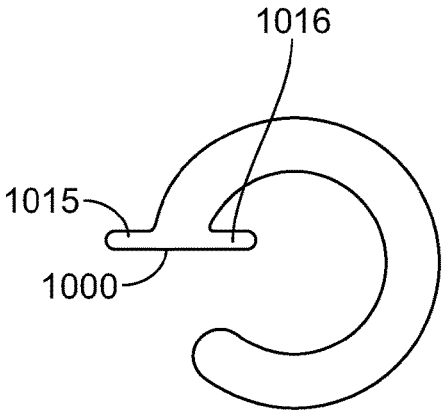
FIG. 30 is a front view of a further embodiment of a ring of the present invention for use with curtains consistent with the present invention.
Figure 31:
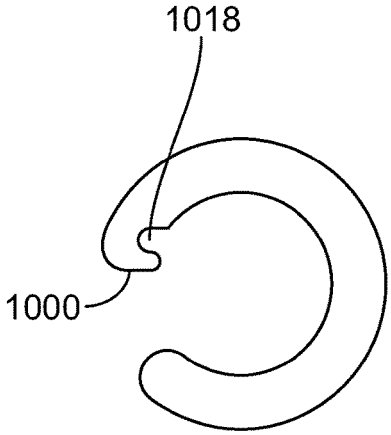
FIG. 31 is a front view of a further embodiment of a ring of the present invention for use with curtains consistent with the present invention.
Figure 32:
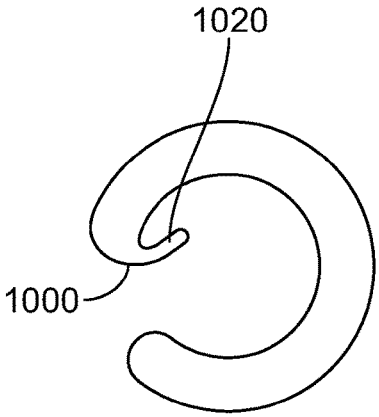
Figure 33:
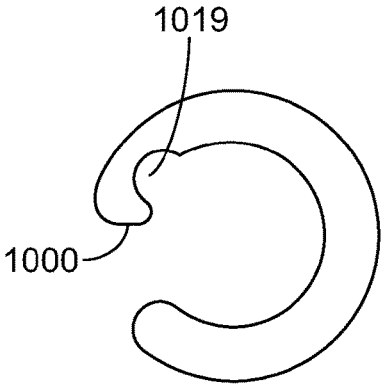
FIG. 33 is a front view of a further embodiment of a ring of the present invention for use with curtains consistent with the present invention.
Figure 34:
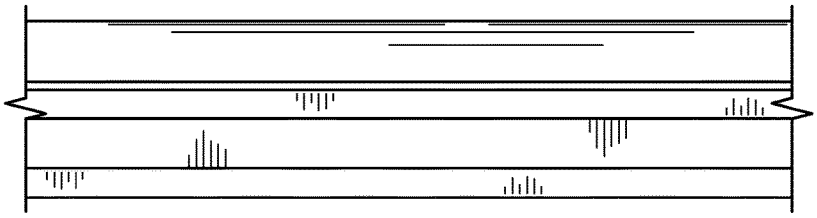
FIG. 34 is a back view of a component of an embodiment of the track system of the present invention.

There are a variety of forms which this ring can take. As shown in FIG. 27 the ring can have two internal extensions 1010 and 1012. As shown in FIG. 28, the ring can have one single straight internal extension. As shown in FIG. 29, the ring can have a single straight internal extension that has a vertical rise 1014 extending from the end of the extension 1000. As shown in FIG. 30, there can be a single internal 1016 and external 1015 finger-like extension. As shown in FIG. 31, the ring can have a notch 1018 in the mouth of the ring, acting as the internal extension. As shown in FIG. 32, the ring can have a single curved internal extension 1020. As shown in FIG. 33, the ring can have a larger notch 1019 in the mouth of the ring, as compared with FIG. 31, likewise acting as the internal extension.

Rings or openings 62 are either integral parts of the curtain (i.e. are openings in the curtain, such as reinforced holes without a separate attached ring), or preferably are relatively rigid rings attached to openings in the curtain's more flexible material. In the preferred embodiment of the invention, rings 62 have been configured such that ring opening (ring mouth) 68 is angled and dimensioned corresponding to the entry angle of the bottom of the side mount 190 (affixed to vertical support 210) as shown, for example, in FIG. 10. In this preferred embodiment, the ring mouth is a large gap, with that mouth or gap being directed at an angle down toward the ground when the curtain is hanging on the track.

Preferably, this angle is greater than zero degrees down off of an imaginary horizontal reference line parallel to the ground (such that zero degrees would correspond to a flat, horizontal, gap) but angled less than or at most ninety degrees downward. Further preferably, the angle is sixty degrees or less, or forty five degrees or less, or thirty degrees or less, down from a horizontal reference line. As previously noted, the particular angle further preferably corresponds to the entry angle of the bottom of side mount 190, which is the angle upward formed between segments 196 and 198 of side mount 190, i.e. the angle formed between segments 196 and 198 when segment 196 is affixed to bottom end 218 of vertical support 210, with bottom end 218 of vertical support 210 and segment 196 being horizontal (or approximately horizontal), according to one preferred embodiment.

Ring mouth 68 or 900 is an open slot allowing the ring to glide past the bar support, and providing the ability to hold the weight of the curtain while maintaining the easy on/off nature of the ring and system concept. Preferably, the ring mouth is sufficiently wide to allow the ring to easily be inserted onto the track without needing to flex the ring (or alternatively, without needing it flex it too excessively), yet narrow enough to sit on the track without easily coming off during use, with the width/narrowness of the mouth also being configured to easily pass the support mounts. Slit 76 of the curtain is likewise a wide slit, i.e. a slit dimensioned with a sufficiently large width to allow easy attachment and detachment of the curtain, and facilitate easy sliding of the curtain along the rod.

A projection, extension or finger can also be provided to the side of the ring or the mouth of the ring as shown in FIGS. 18, 19 and 20 of U.S. Pat. Nos. 6,494,248; 6,935,402; and 7,296,609; all of those patents being incorporated herein by reference. One or two projections can be provided off of the ring, as with the projecting edge, flange, extension, or finger discussed in those patents. The projections can be off of the side of the ring and/or off of the ring's mouth. For example, one or two projections can be provided, each projection being located adjacent to and to the side of the ring mouth. If two extensions are provided, one is preferably provided on each side of the mouth. For example, one preferred embodiment has a finger-like extension 1013 at the end of the ring mouth which will serve to stabilize the ring on the track, further preventing it from rotating or coming off during use.

Figure 25A:
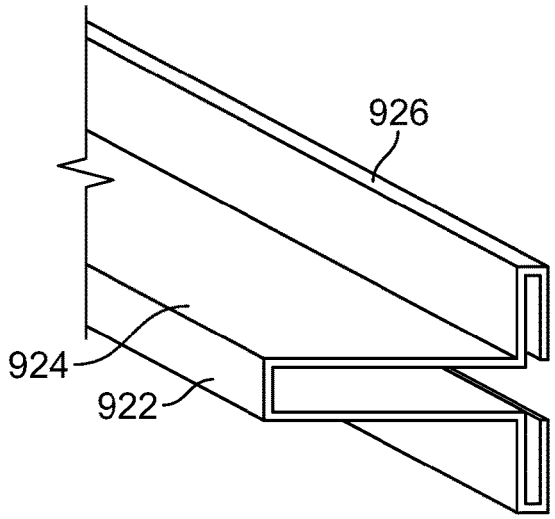
FIGS. 25*a* and 25*b* are perspective views of the guiderail and a section of the track, respectively, with FIG. 25*c* being a view of the guiderail and section of track coupled together.
Figure 25B:
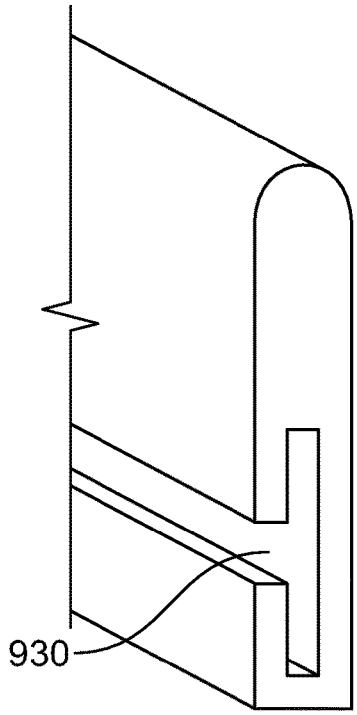
Figure 25C:
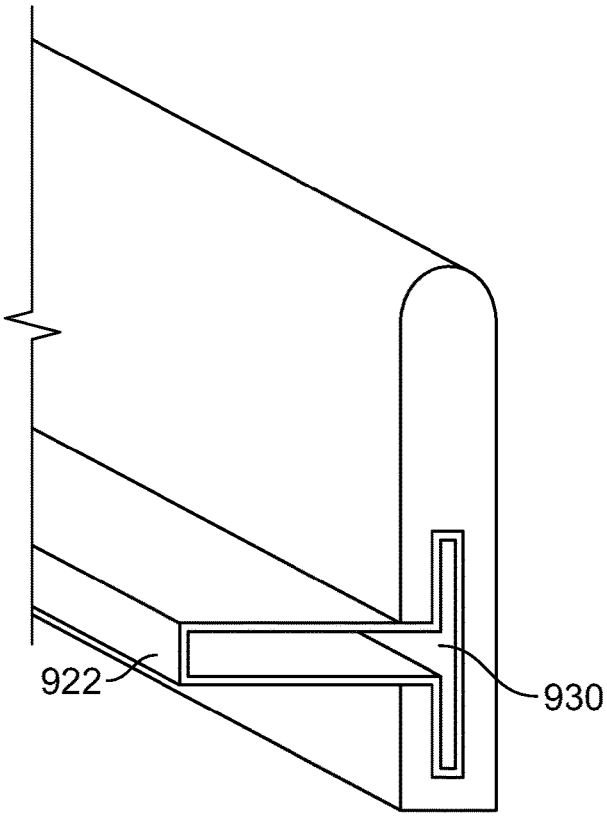
FIG. 25 includes views of a further embodiment of the present invention, wherein the track includes a guiderail. Specifically.
FIG. 25*d* is a perspective schematic view of the embodiment of FIGS. 25*a*-25*c*, showing the curtain resting on the track section which includes the guiderail, and showing attempted rotation of the curtain ring.
FIG. 25*e* is a perspective view of the embodiment of FIGS. 25*a*-25*d*, showing the curtain resting on the track section, and illustrating the guiderail, vertical mount, and side mount.
Figure 26:
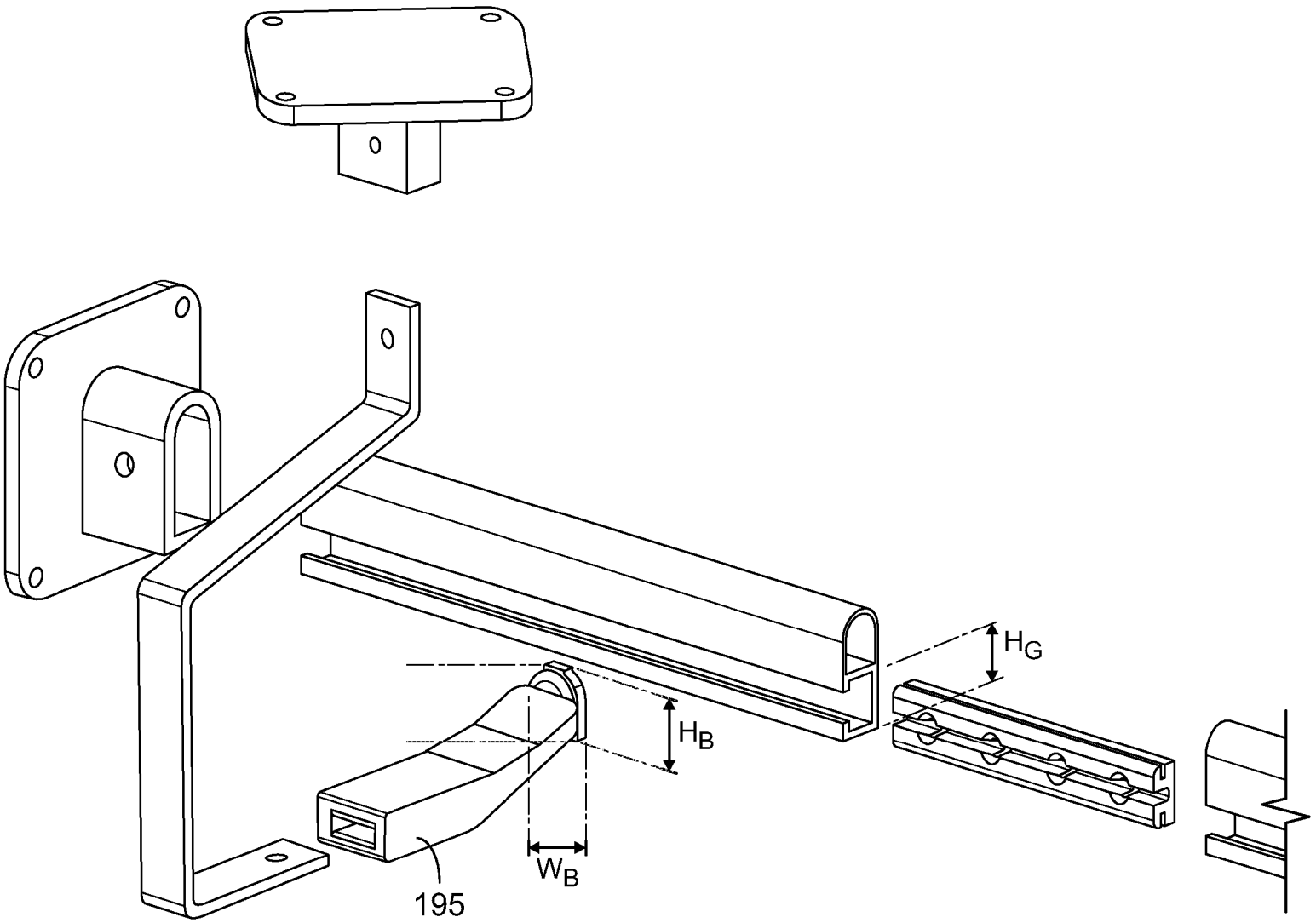
FIG. 26 is an exploded view of a further embodiment of the present invention wherein the side mount locks onto the track section.

In a further embodiment of the invention, the track system includes at least one guiderail 922, as shown in FIGS. 25*a, c, d* and *e*. Guiderail 922 of FIG. 25*a* is a bar, rail, shelf, flange, lip or edge 924 which projects or extends from the back 926. Thus, guiderail 922 projects out from the body 224 of track section 220, and preferably also extends along that body. The guiderail 922 provides a unique interface between the curtain and track which improves the movement of the curtain on the track, and acts as a stabilizer bar. The guiderail also interferes with and prevents detachment of the ring from the track during use.

In a preferred embodiment, guiderail 922 is positioned above the side support. This positioning allows for better interface between the guiderail and the inward facing finger-like extension 1013 protruding from the mouth of the ring (see, e.g., FIG. 38). In this embodiment there is even more stability provided as the finger-like extension interacts with the guiderail in a way that blocks the ring from rotation.

The guiderail may be provided along part or all of the inner perimeter of the track, and can project outward by any desired distance. The guiderail can also project from the track at any desired angle, whether ninety degrees, or any other angle from zero to 180 degrees. Thus, the guiderail can angle toward the floor or the ceiling (or anywhere in between) when the track is mounted.

In a preferred embodiment, the guiderail 922 extends horizontally, or approximately horizontally, from the body 224 of the track component. Further preferably, the guiderail is perpendicular (at a 90 degree angle) to the body 224 of the track, and is preferably parallel to the ground. In that embodiment, the combination of the body 220 of the track, and the guiderail 922 extending from it form the shape of, or approximately the shape of a sideways "T" (a "T" resting on its side, so that the combination of body and guiderail are approximately T-shaped in cross-section). In other words, the body 224 of the track provides the vertical bar of the T (which would be the top segment of the T if the T were not on its side), and the guiderail or stabilizer bar 922 provides the attached horizontal bar (which would be the vertical segment of the T if the T were not on its side). Those vertical and horizontal bars can themselves be any shape, length, or cross section desired. In a preferred embodiment, the guiderail is also, preferably, positioned near the bottom edge of the track, although, alternatively, it can be positioned anywhere from the top to the bottom edge of the track section. At least one guiderail is provided on a track section, although more can be used if desired.

The guiderail can also extend from either side of the track, whether the inner perimeter or outer perimeter or both. For example, it can extend from the side that the vertical support and side mount attach to (referred to as the back side, merely for reference); or the opposite side (referred to as the front side, for reference); or both sides of the track.

In a preferred embodiment, the guiderail extends from the back side of the track (the inner perimeter when it surrounds a bed), as shown in FIG. 25. In this embodiment, the guiderail can be attached to any part of the track component of FIG. 25*b* by sliding the back 926 into groove 930 of the track (or by otherwise attaching the guiderail to the track component), to form the track. As shown in FIGS. 25*c* and *d*, the guiderail is inserted into the groove of the body 224 of the track section to extend from that body.

In a preferred embodiment, the guiderail is positioned on the upper portion of the track above the side support. As shown in FIG. 35, the guiderail is on the upper portion of the track.

As an alternative to a detachable guiderail, the guiderail and track component can be constructed or molded as a single integrated unit. In other words, the body 224 of the track 220 and the guiderail 922 can be detachable (as shown in the figures), or the body 224 and guiderail 922 can formed into a single, non-detachable unit. In any of the embodiments of the invention, the guiderail can be the same material as the track component or a different material, if desired.

As discussed above, the curtain is designed with a ring that has a mouth which can pass over the vertical supports and/or the side mount (which are preferably attached to the side of the track). The preferred ring is a C-shaped ring (such as ring 62, for example), with the mouth or gap 900 in the ring being the gap in the "C". Further preferably, a combination curtain 60 and track component 220 is used, wherein the curtain uses the C-shaped ring described above, and the track component 220 has the guiderail 922 extending therefrom. In this preferred embodiment, the guiderail 922 extends toward the gap 900. Or, the guiderail 922 can extend or project into the gap 900 of the ring 62, whether partially into that gap, or into and through that gap.

An alternative embodiment has a ring with a finger-like extension (FIGS. 27-33) projecting inward or outward. There are a variety of forms which this ring can take. The ring can have one, or multiple extensions. These extensions can be straight or curved. The extension can have a straight vertical rise. The extension can alternatively consist of a large or small notch in the mouth of the ring.

Figure 25D:
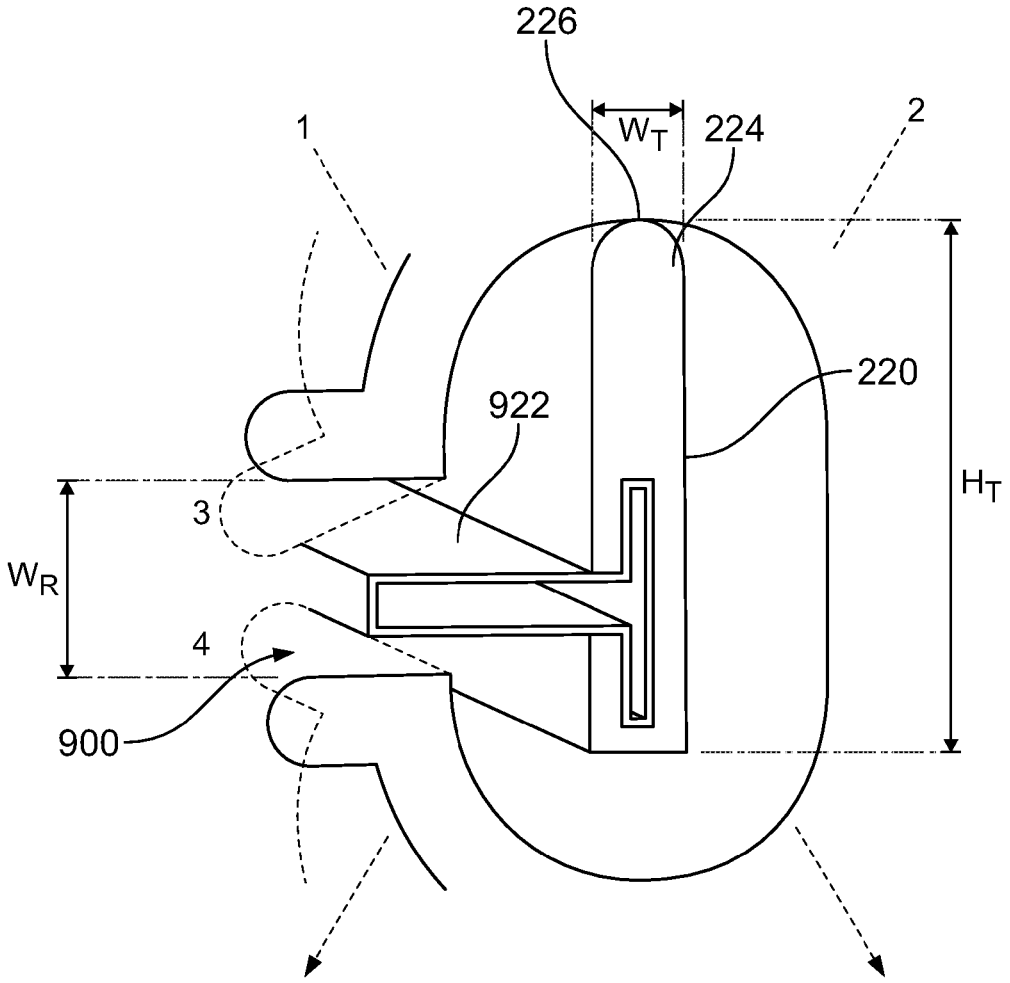
Figure 25E:
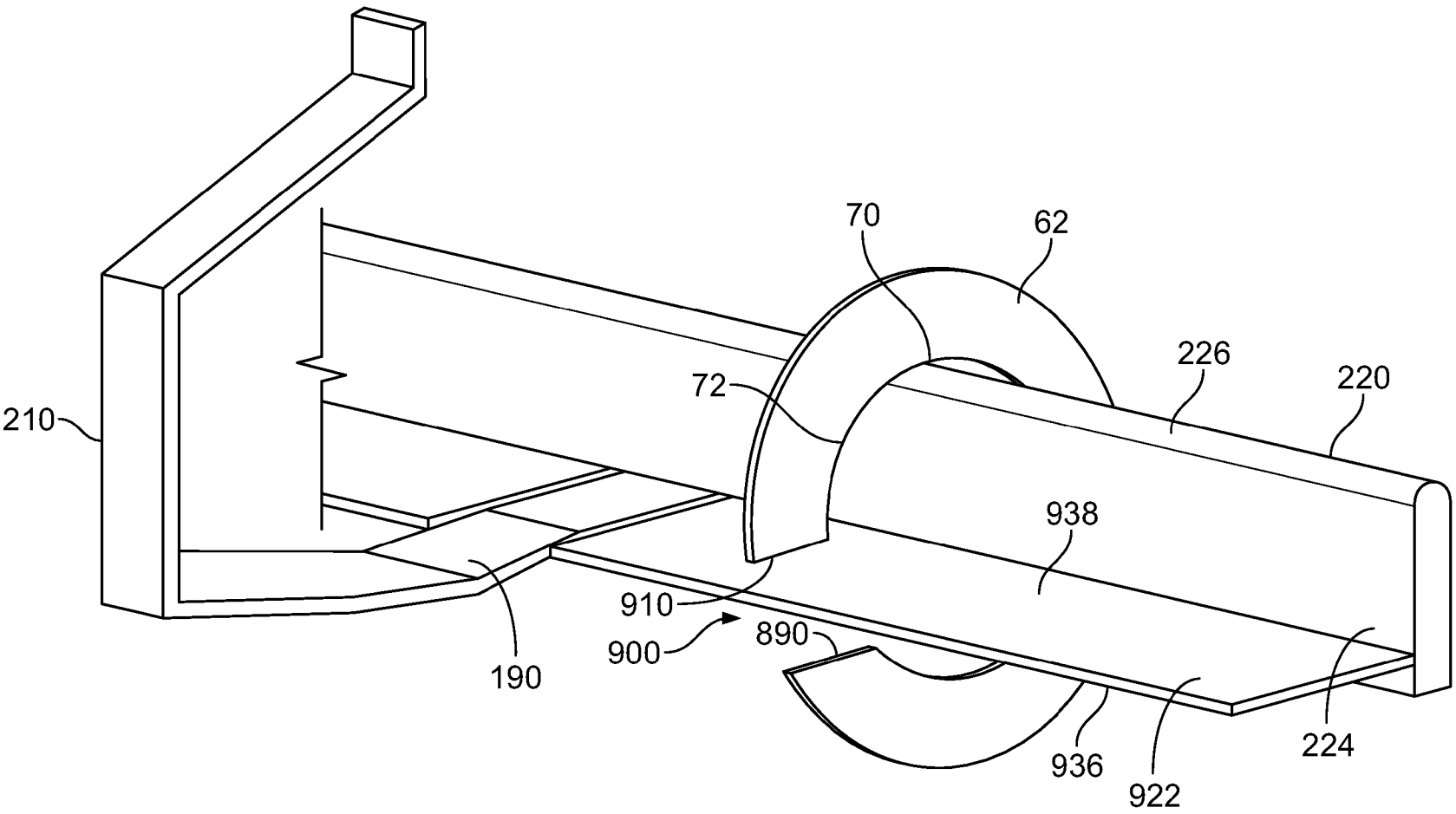

Thus, in that preferred embodiment, as shown in FIGS. 25*d* and 25*e*, the curtain includes an opening therein with an inner circumference, that opening being integral to the curtain, or being a ring 62 having an inner circumference 72. The top 70 of the inner circumference 72 of that opening or ring 62 rests on the top 226 of the track 220 when the curtain is stationary; with that top 70 of the inner circumference gliding on and along that top 226 of the track when the curtain is moved along the track.

As also shown in FIG. 25*e*, guiderail 922 extends into mouth 900 of ring 62, with the top surface 938 of the guiderail 922 being opposite the top surface 910 of the mouth 922 and the bottom surface 936 of the guiderail 922 being opposite the bottom surface 890 of the mouth 922, when the curtain is suspended from the track section. Preferably, the top and bottom surfaces of the guiderail are spaced from the top and bottom surfaces of the mouth. Alternatively, the top surface of the mouth can rest against the top surface of the guiderail and/or the bottom surface of the mouth can rest against the bottom surface of the guiderail. In certain embodiments, the mouth of the ring can glide above and along the length of the guiderail when the curtain is moved along the track.

As shown in FIGS. 25*d* and 25*e*, a wide mouth ring is preferably provided to facilitate the movement of the mouth over the vertical support 210 and side mount 190 when the curtain is moved along the track. In a preferred embodiment, as shown in FIG. 25*d*, the ring mouth's width (Wr) is larger than the width Wt at the top 226 of the track 220, to facilitate placement of the ring on the track. It should be noted that the mouth is only wider than the width of the track Wt when the mouth is being inserted onto the top of the track (i.e. when the mouth is in the 6:00 position)—the mouth is not wider than the height of the track (Ht). Alternatively, the ring mouth can be wider than the height of the track when using a rounded track or a track with a lesser height.

As also shown in FIGS. 25*d* and 25*e*, guiderail or stabilizer bar 922 blocks rotation of the movement of the mouth of the ring, restricting excessive upward or downward rotation, and also preventing accidental detachment of the ring from the track. During use, it is common for the ring to move about one or more axes of the track, whether to partially rotate or swing about the track, or so forth. For example, when a user pulls down on the curtain of FIG. 25*d* (from the right side of the figure towards the left), the mouth of the ring will normally rotate upward (toward the dotted outline marked "4" on the figure, i.e. clockwise). Conversely, pulling down on the curtain of that figure (from the left side of the figure towards the right), will normally rotate the mouth of the ring downward (toward the dotted outline marked "3" on the figure, i.e. counterclockwise).

In an alternative embodiment there is a finger-like extension protruding from the mouth of the ring which provides additional stability. The extension 1010, 1012, 1013, 1014, 1015, 1016, 1018, 1019, 1020 (FIGS. 27-33) blocks rotation of the movement of the mouth of the ring, restricting excessive upward or downward rotation, and preventing accidental detachment from the track (which may otherwise occur when the ring is in a 12 o'clock position).

In the embodiment in which the guiderail 922 extends into mouth 900, the guiderail restricts this rotational movement, blocking any excessive, undesired, rotation of the ring. A finger-like extension as shown in FIGS. 27-33 can further block excessive or undesired rotation of the ring. As shown in FIG. 25*d*, upon initial rotation, the mouth of the ring will hit the guiderail 924 preventing further rotation upward or downward. In particular, the inside top surface 910 or inside bottom surface 890 of the mouth or gap 900 of the ring will hit or contact the guiderail or stabilizer bar 922 once rotation exceeds a certain predetermined angle, blocking further rotation of the ring. Furthermore, this configuration prevents detachment of the ring from the track. Since the height Ht of the body 224 of track section 220 is greater than width Wr of mouth 900 of the ring, the ring cannot be accidentally detached. Specifically, the ring cannot be detached from the track when the mouth is in another position other than one near the top of the track. To achieve this, the ring 62 must be pushed from the right to the left of FIG. 25*d* until the guiderail no longer extends into the mouth 900, and then the ring must be rotated clockwise until the gap 900 coincides with width Wt of the body 224 of track section 220. As width Wt is less than width Wr, the ring can now be pulled downward and off the track.

Furthermore, since the guiderail 922 restricts rotation of the ring, the guiderail prevents the mouth 900 from catching on the top 226 of the track section 220 during use. By preventing excessive ring rotation and keeping the top of the inner circumference of the ring aligned with the top of the track, the guiderail stabilizes the motion of the ring so as to provide comfortable and smooth movement of the curtain along the track. In the alternative embodiment shown in FIG. 38, the guiderail also stabilizes the motion of the ring through its interaction with extension 1000.

The guiderail can extend along part or all of the track to extend along the entire periphery of the track, or any portion thereof, as desired. Thus, for any adjacent first track section, second track section and third track sections, the guiderail can be included on all of those sections, or can be left off of any of those sections. Even a partial guiderail provides a benefit, as that guiderail restricts rotation of the ring located along it, and thereby further restricts rotation to a certain degree in adjacent areas of the curtain. In addition, while one guiderail per track section is preferred, multiple guiderails can alternatively be provided, if desired.

As shown in FIG. 25*e*, the guiderail and side mount (and/or vertical mount) are preferably aligned, so that the mouth of the ring moves smoothly over both. In other words, preferably the guiderail 922 passes through the mouth 900 of ring 62, with that mouth 900 gliding along the guiderail 922 (whether the mouth is spaced from the guiderail or in contact with it), when the curtain is moved along the length of the track. Likewise preferably, and as also shown in FIG. 25*e*, the vertical mount 210 and/or the side mount 190 also pass through mouth 900 when the curtain moves along that track.

Figure 21A:
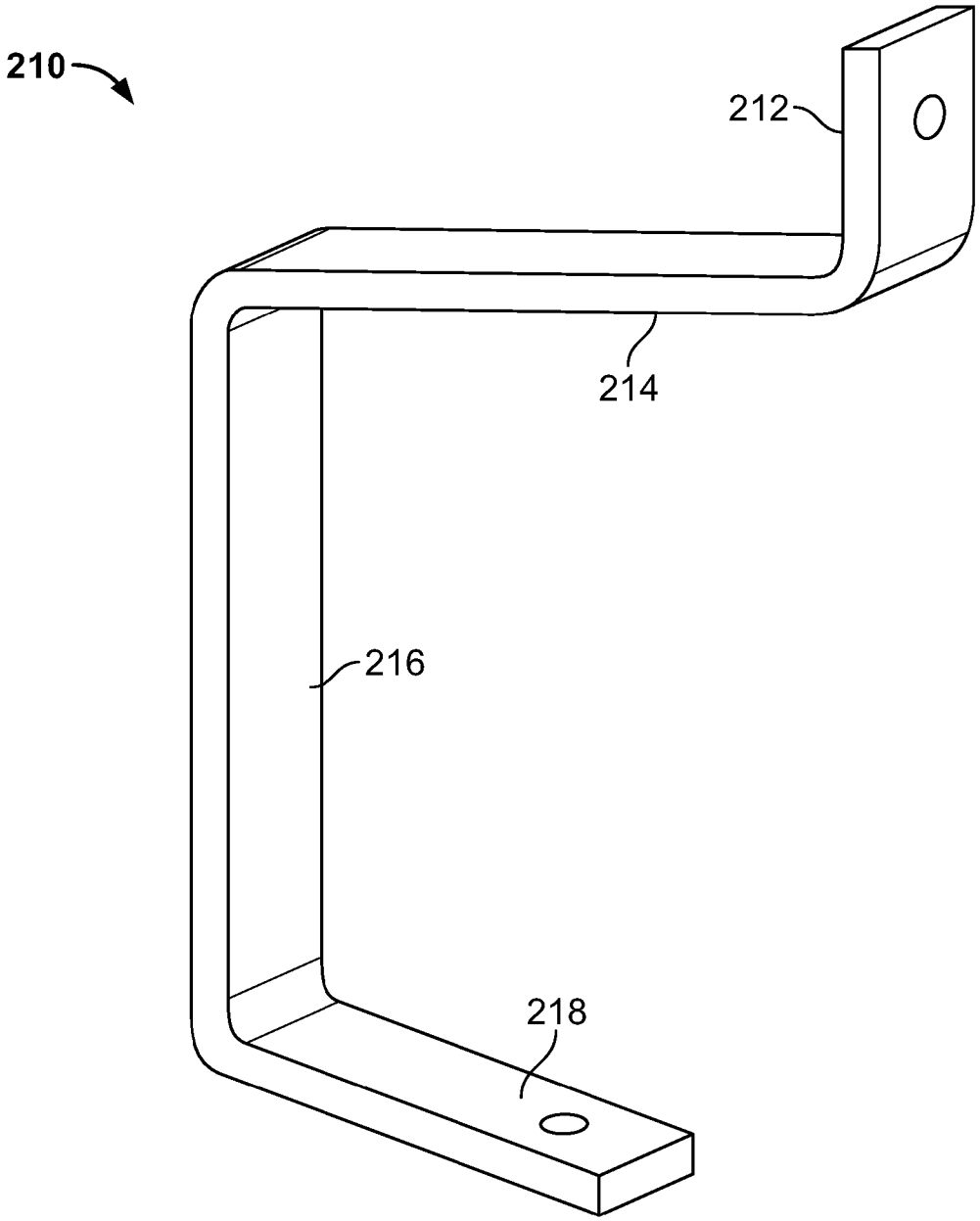
FIG. 21*a* is a perspective view of a further component of an embodiment of the track system of the present invention.
Figures 1, 21B:
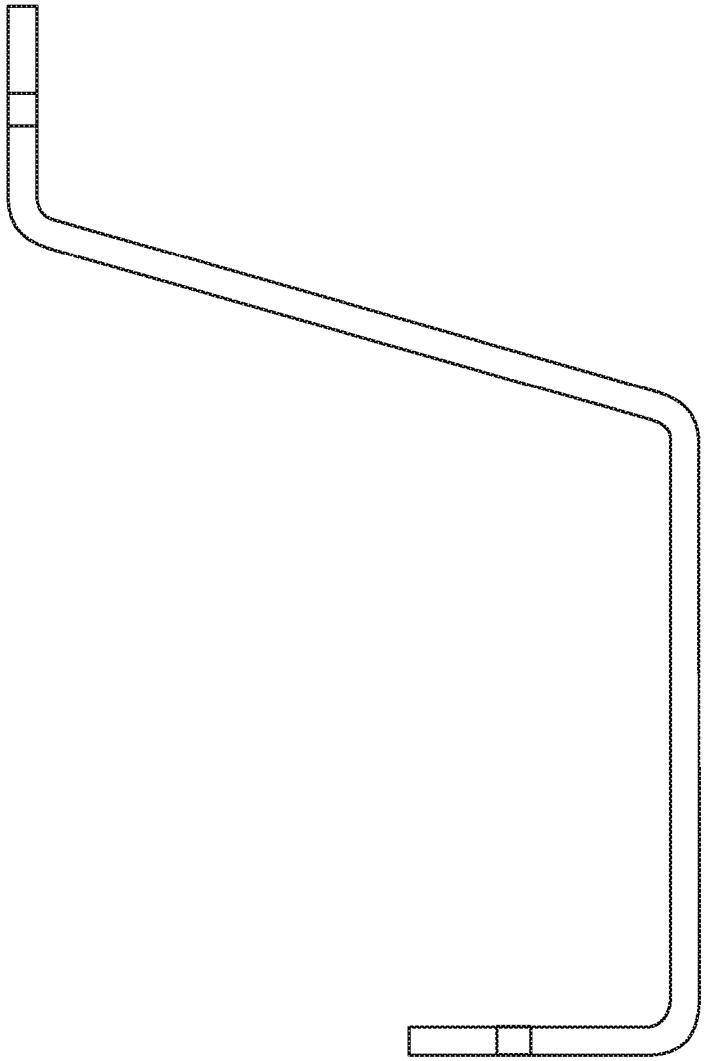
Figures 2, 21B:
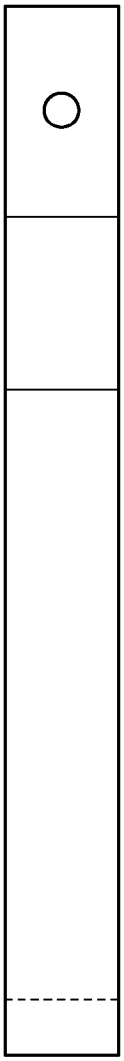
Figure 22A:
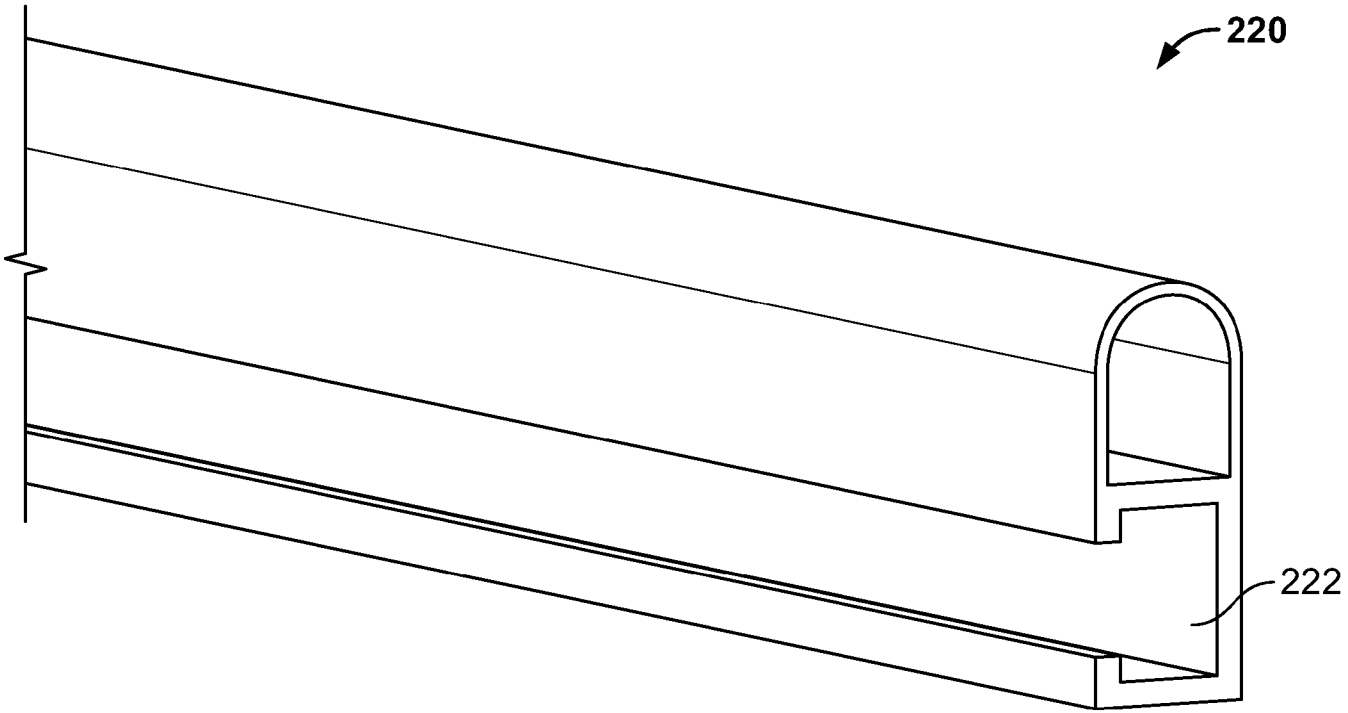
FIG. 22*a* is a perspective view of a further component of an embodiment of the track system of the present invention.
Figures 2, 22B:
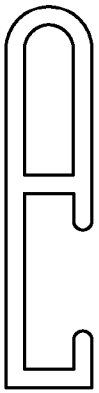
Figures 1, 22B:
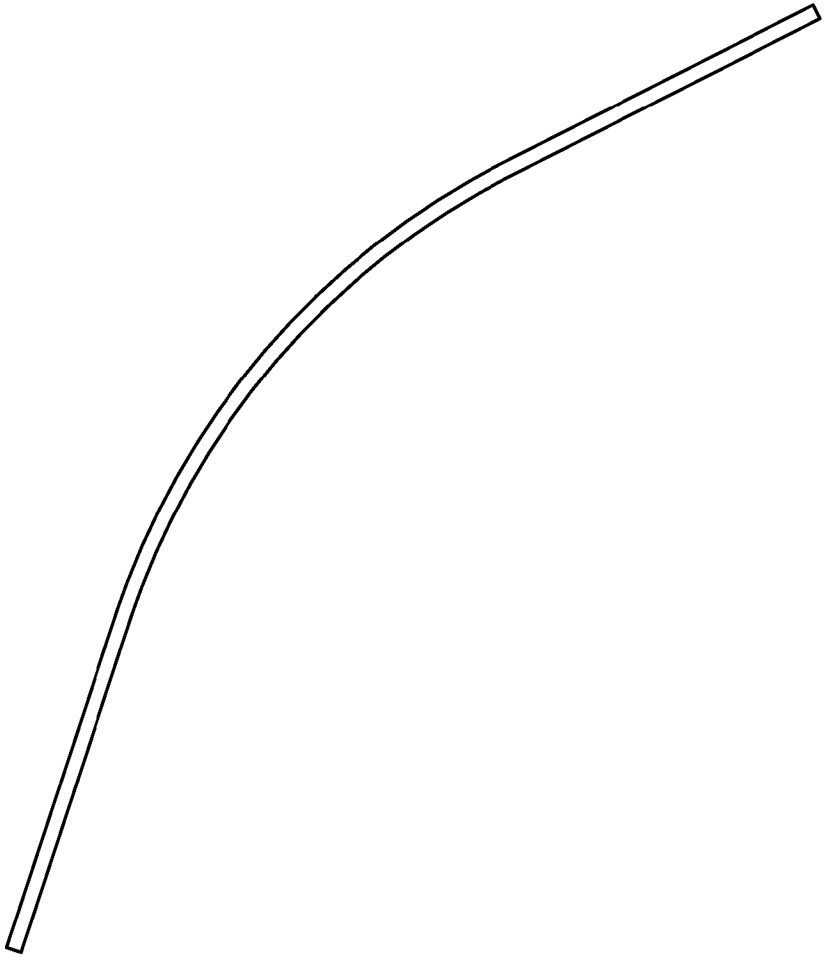
Figures 4, 22B:
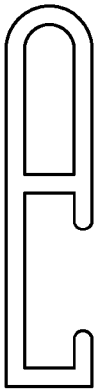
Figures 3, 22B:
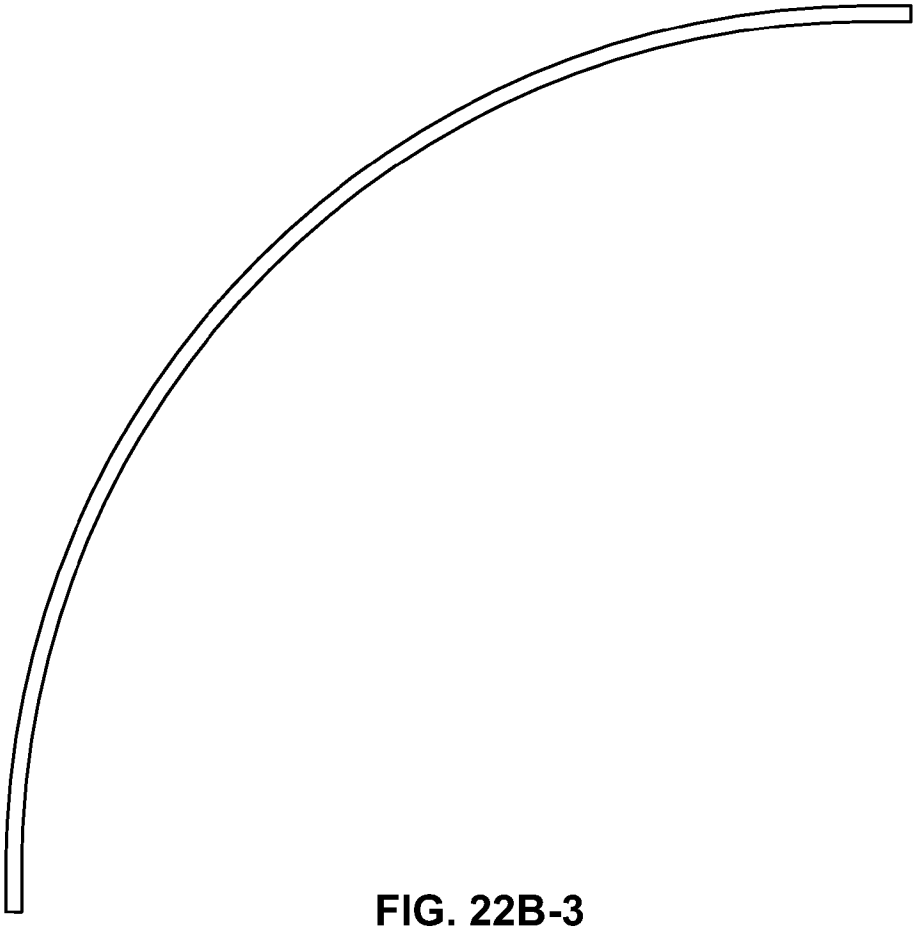
Figure 23:
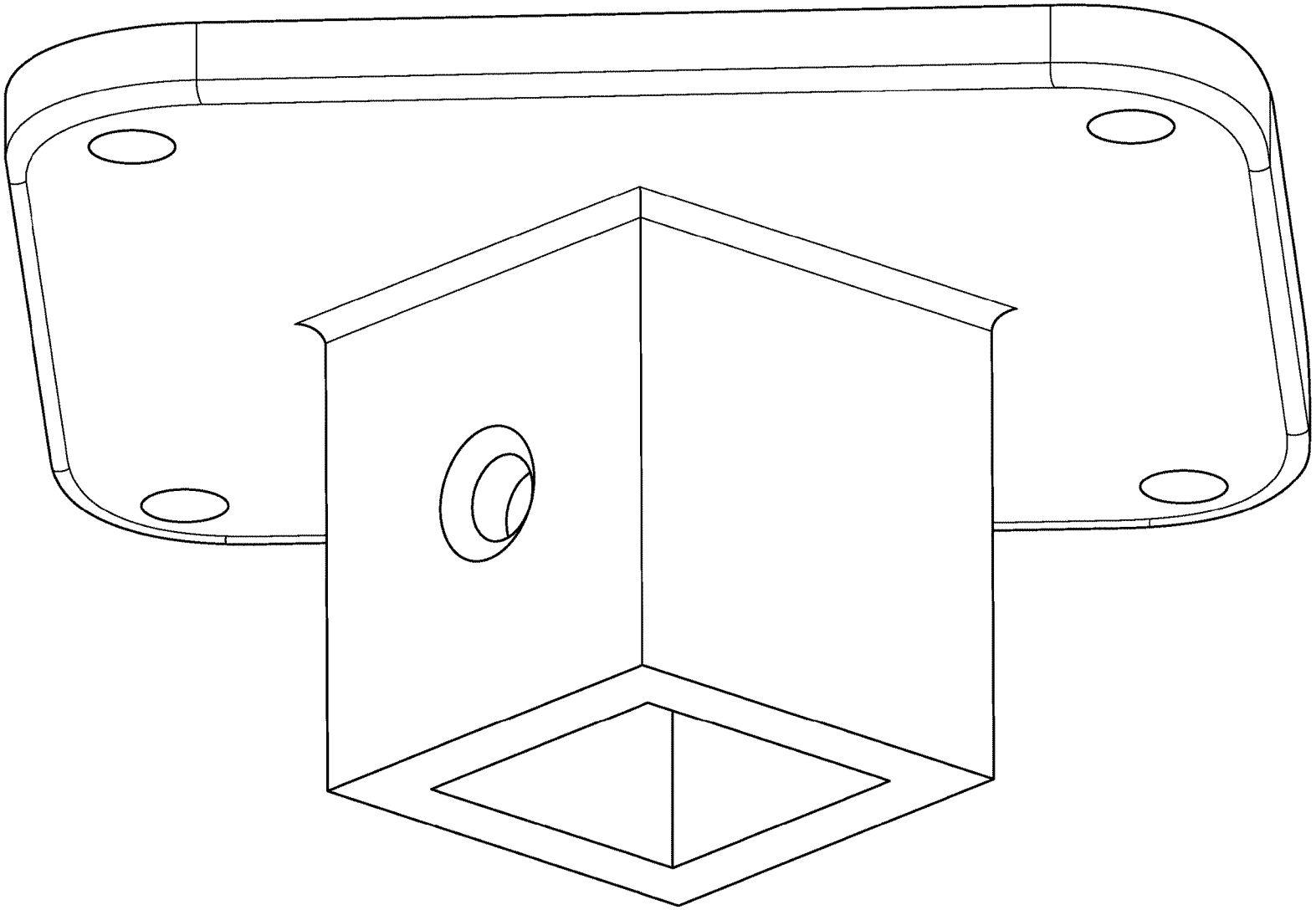
FIGS. 23 and 24 are perspective views of further components of one or more embodiments of the track system of the present invention.
Figure 24:
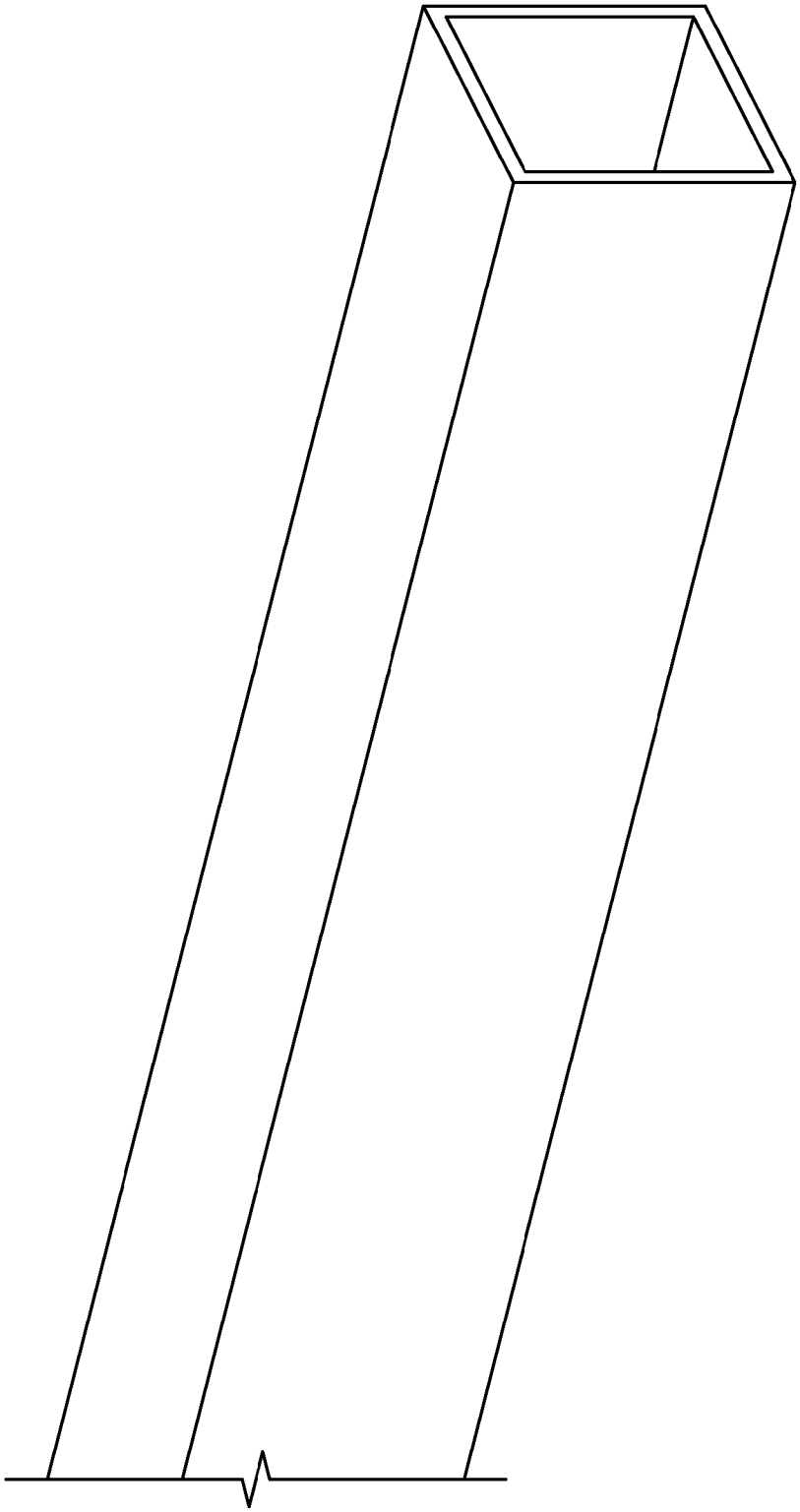

In addition, as shown in FIGS. 21*a*-21*b*, vertical mount 210 is preferably a curved component. That curved component preferably has at least one segment which is approximately in a C-shape, to accommodate the sliding of the curtain within the space enclosed by segments 214, 216 and 218. As shown in that figure, segment 214 extends in a direction away from the curtain, segment 216 extends down parallel or approximately parallel to the edge of the curtain, and segment 218 travels back toward the curtain. Alternatively, a more rounded or hemispherical configuration C-shape can also be used, provided that the dimensioning is configured to allow the curtain to easily slide within the space enclosed by the vertical mount. The vertical mount also has end 212 for attachment to a fixed support or to a ceiling mount.

Accordingly, using the design provided a modular section of curtain (usually six feet long) can be easily attached to the track in one simple movement, and can be accomplished by a single person without the use of tools. Since there is no moving part other than the curtain, movement is quieter, smoother and more stable than existing track curtains. The materials used for the track and ring are further selected to maximize the smooth and quiet movement of the ring on the track.

Figure 47:
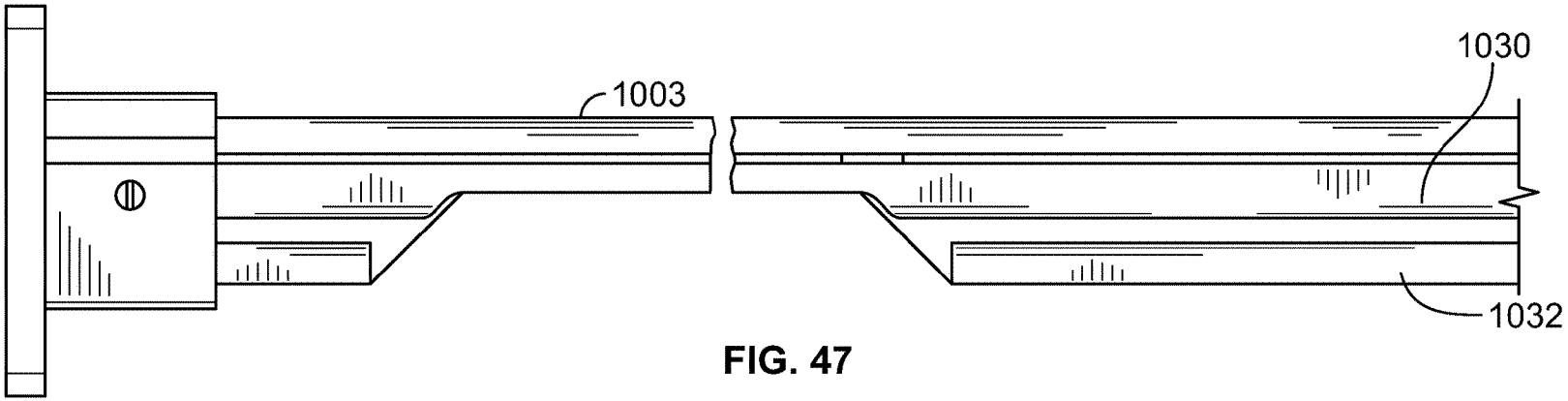
FIG. 47 is a back view of the loading zone section of the track of FIG. 46.
Figure 48:
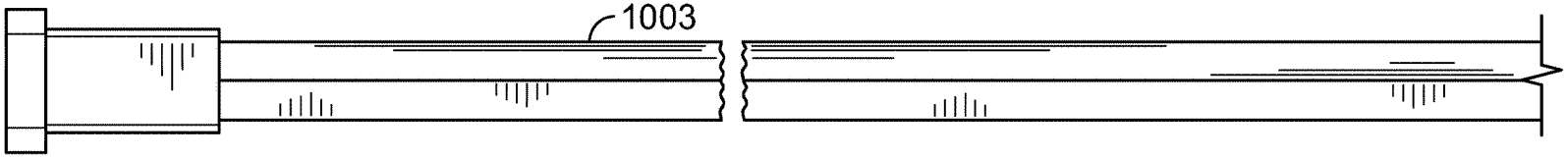
FIG. 48 is a top view of the loading zone section of the track of FIG. 46.
Figure 49:
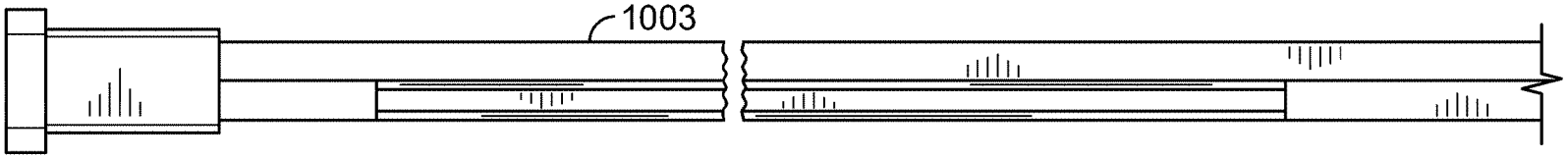
FIG. 49 is a bottom view of the loading zone section of the track of FIG. 46.

In an alternative embodiment, a loading zone 1003 (FIGS. 46-49) can be included on the track. The loading zone comprises a narrower section at the beginning of the track on which the rings of the curtain are initially loaded, the narrow nature of this section facilitating insertion into the rings. The narrow nature of this section allows for horizontal mounting of the curtain, as opposed to the vertical mounting which may otherwise be necessary. The curtain rings slide onto the loading zone more easily and then continue to the thicker part of the track which widens out after the loading zone section. In one embodiment, the thicker portion of the track further comprises outwardly extending guides 1030, 1032 (FIG. 47) for additional stability. The narrowness and horizontal insertion allow the track to be positioned higher up and closer to the ceiling, which further limits ring rotation as the ring would hit the ceiling and be stopped if rotation were attempted.

Likewise, the use of minimal moving parts also ensures that the system is more reliable and less costly than the systems of the prior art. The system and curtain design further ensures that the curtain will not come off the track or become entangled. The manner in which the curtain drapes due to the paired ring configuration also eliminates tie backs, reduces bulk, and is more aesthetic than the prior art curtains, such as those currently used in hospitals and related settings (such as nursing homes).

Figure 11:
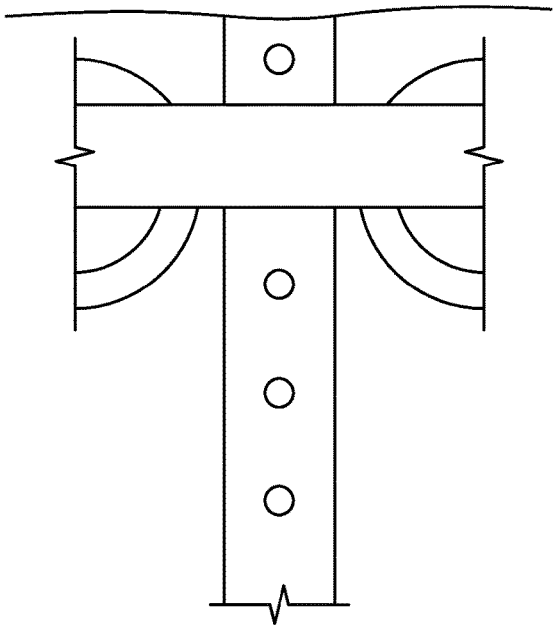
FIG. 11 is a rear view of an embodiment of the invention in which two modular curtains are used, the curtains attaching together and hanging from the track.
Figure 12:
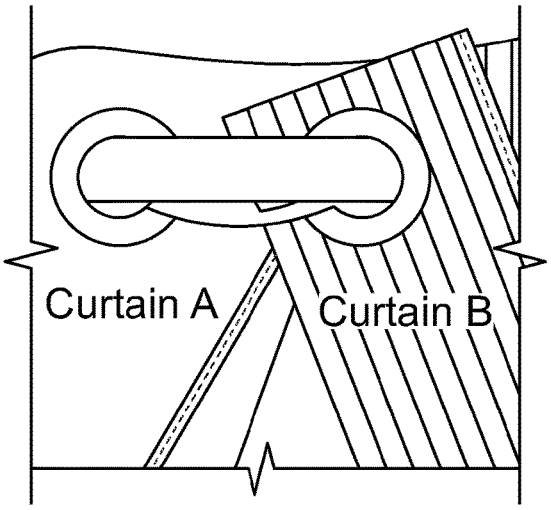
FIG. 12 is a rear view of a further embodiment of the curtains, wherein the curtains overlap at their top ends, with a gap between the curtains, to create an entry or exit area for passing through the curtains and into or out of its enclosed space.
Figure 13:
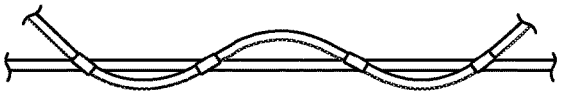
FIG. 13 is a top view showing the layering of two curtains on a track, in accordance with an embodiment of the invention.
Figure 14:
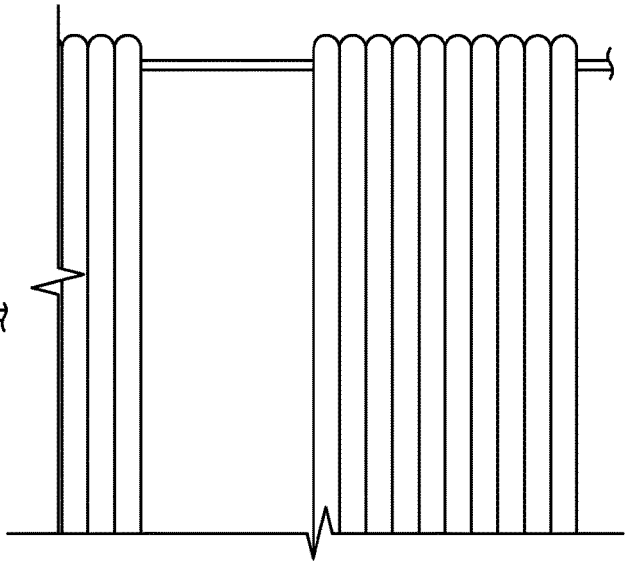
FIG. 14 is a front view showing an embodiment of the invention with multiple stacks of curtains, showing a narrow stack, a wider stack, and an entry/exit area between them.
Figure 15A:
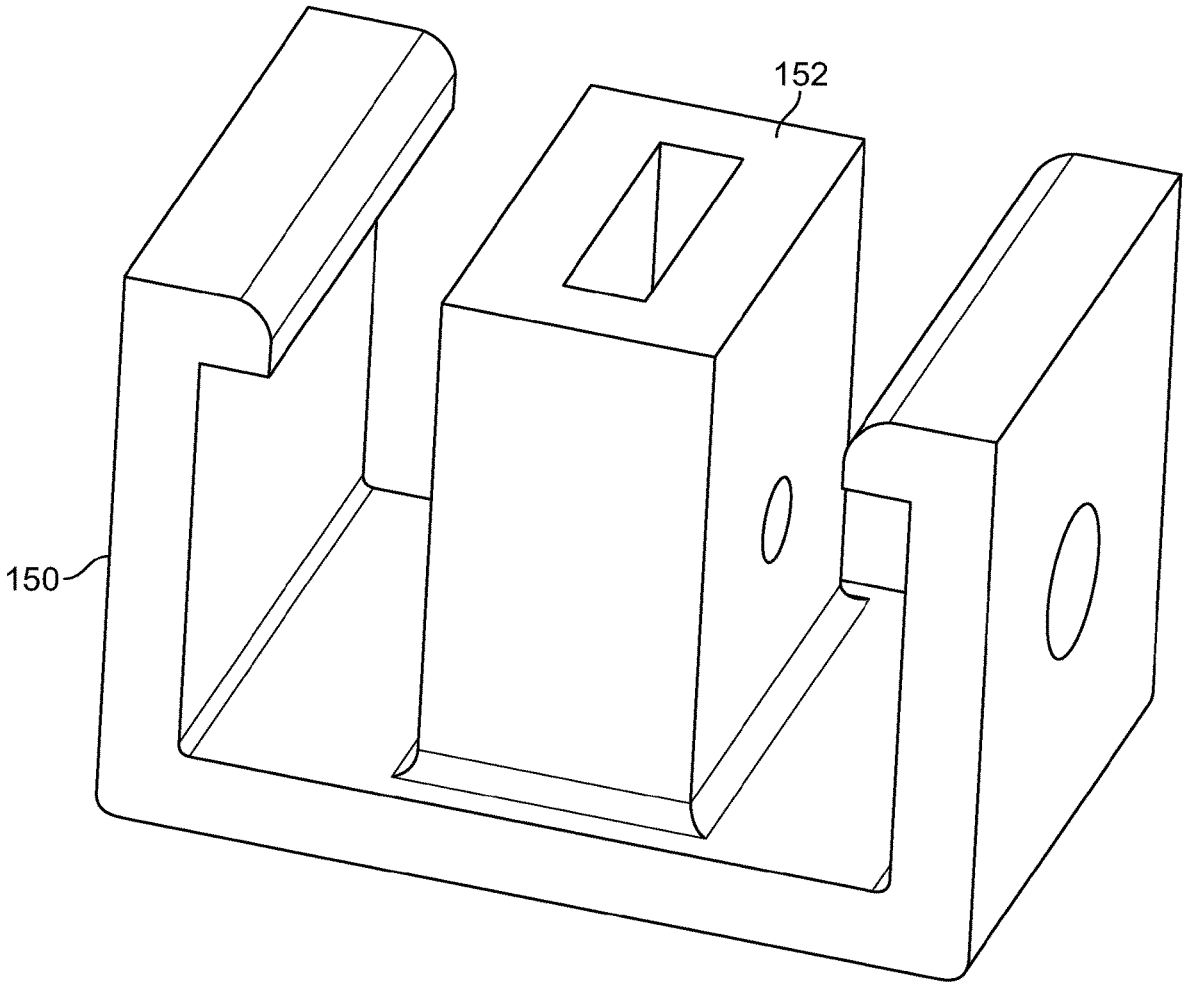
FIG. 15*a* is a perspective view of a component of an embodiment of the track system of the present invention.
Figures 1, 15B:
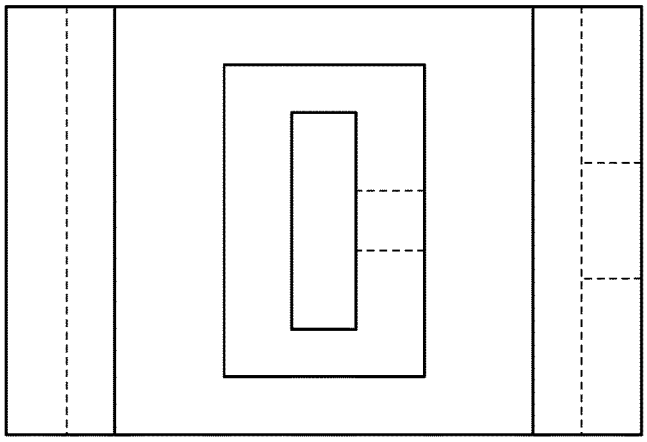
FIG. 15*b*-1 is a schematic of a top view of the component of FIG. 15*a*.
Figures 2, 15B:
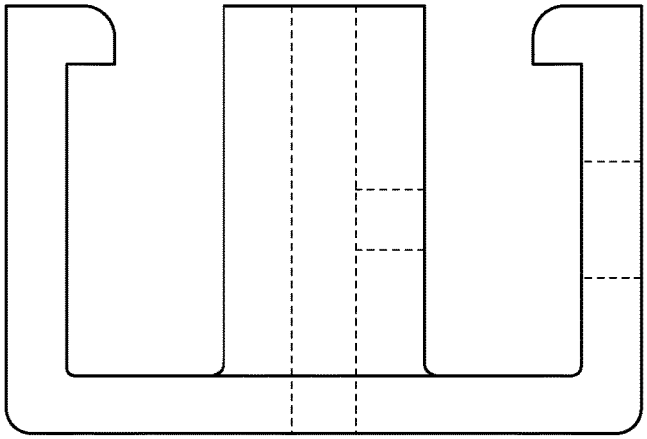
Figures 3, 15B:
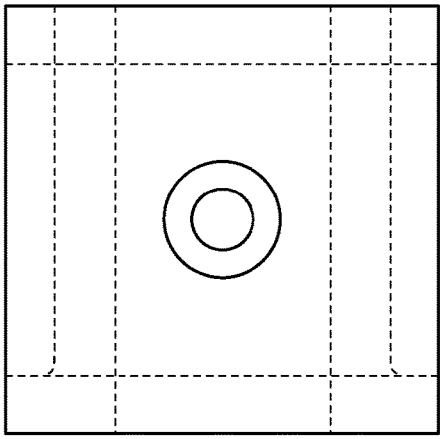
Figure 16A:
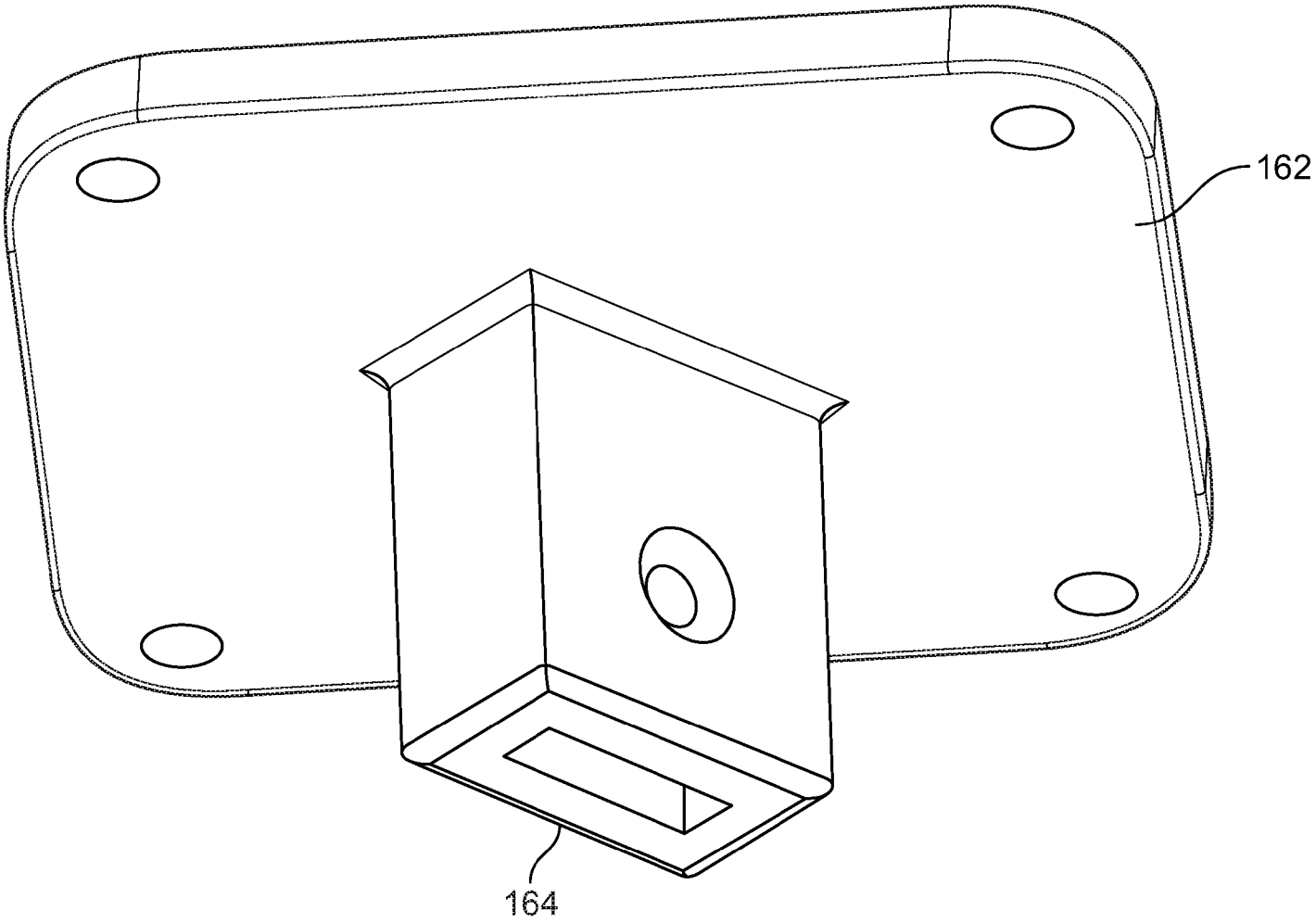
FIG. 16*a* is a perspective view of a further component of an embodiment of the track system of the present invention.
Figures 1, 16B:
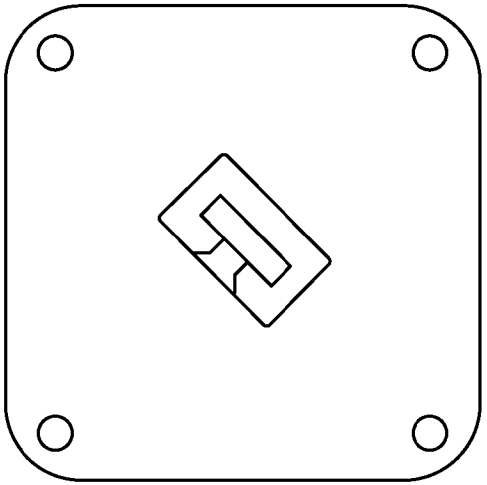
Figures 2, 16B:
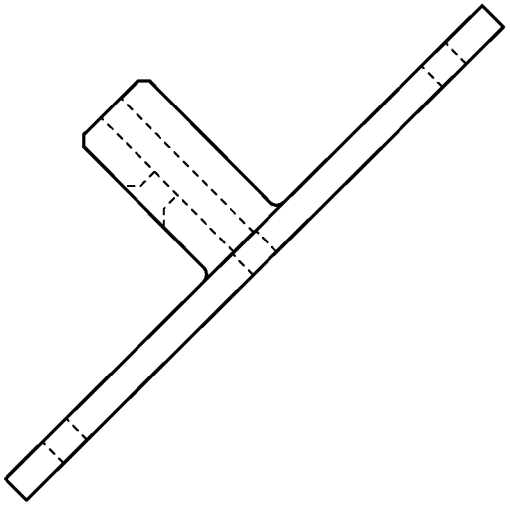
Figures 3, 16B:
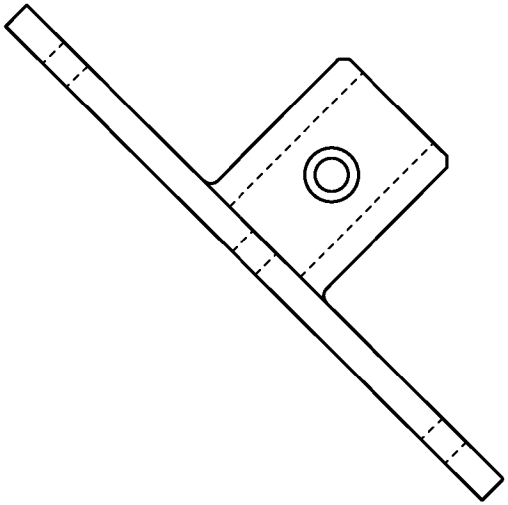

Furthermore, as shown in FIGS. 11, 12 and 13, the curtains themselves can be provided in modular sections that can be attached or removed to the track in sections. As shown in FIG. 12, adjacent overlapping sections of curtain can be used to form entry areas within the curtain, allowing entry to the bed environment wherever desired (e.g. at a mid point of the curtain, rather than at the far ends of the curtain as with existing systems). Likewise, the side edges of the curtains can be attached together using VELCRO®, snaps, buttons, or so forth as shown in FIG. 11. This feature can likewise be used to form doors within the curtain length. Thus, sections of curtains can be attached to each other, overlap each other, or remain separate from one another as needed in the particular environment.

If desired, two (or more) curtains can be layered one on top of the other, as shown in FIG. 13. As shown in that figure, Curtain A forms the entire outer layer of the enclosure, while Curtain B forms the entire inner layer of the enclosure around the bed, the two curtains overlapping with each other along much or all of their length. As one example, this configuration can be used with a disposable liner (as Curtain B) along the inner area of the enclosure. The disposable liner can be discarded or destroyed when blood or other biohazardous materials splatter on it, rather than autoclaving or sterilizing it. The outer Curtain A in this (or any of the other embodiments) can in contrast be more durable and attractive, fabricated in a multitude of finishes to complement the surrounding environment.

The layering can also be used to achieve two different environments. In one preferred embodiment, the outside curtain is designed to complement or blend in with the room decor, while the inside curtain is customized to the particular patient. For example, the inside curtain can be colored and patterned suitable for the age, gender, interests, and tastes of the patient, with a child-like interiors being available for a young child; a feminine interior provided for a female patient; a sports interior provided for a sports fan (whether young or old); and so forth.

Moreover, these short sections of curtain can be attached to and removed from the track individually without needing to remove the entire curtain, whether for cleaning, maintenance or so forth. Thus the track and curtain design not only allows multiple entry points, but also provides the ability to remove or attach sections as needed. Accordingly, the facility can more easily launder sections of curtain using standard washers and dryers, rather than sending them out for laundering using more expensive commercial units. Nonetheless, as discussed above, the curtains can still be snapped together to create long or 'unlimited lengths' and can be disassembled for cleaning or switching out (such that one can clean a part of the curtain without needed to clean the entire length).

This curtain also has a cleaner upper edge appearance than the prior art hospital privacy curtains—whether the curtain is spread around a bed or stacked. The curtains also align (e.g. stack or bunch) in a much narrower silhouette—a 24 foot curtain's stack is approximately twenty inches wide rather than the approximately forty eight inches (or four feet) of the prior art.

Figure 36:
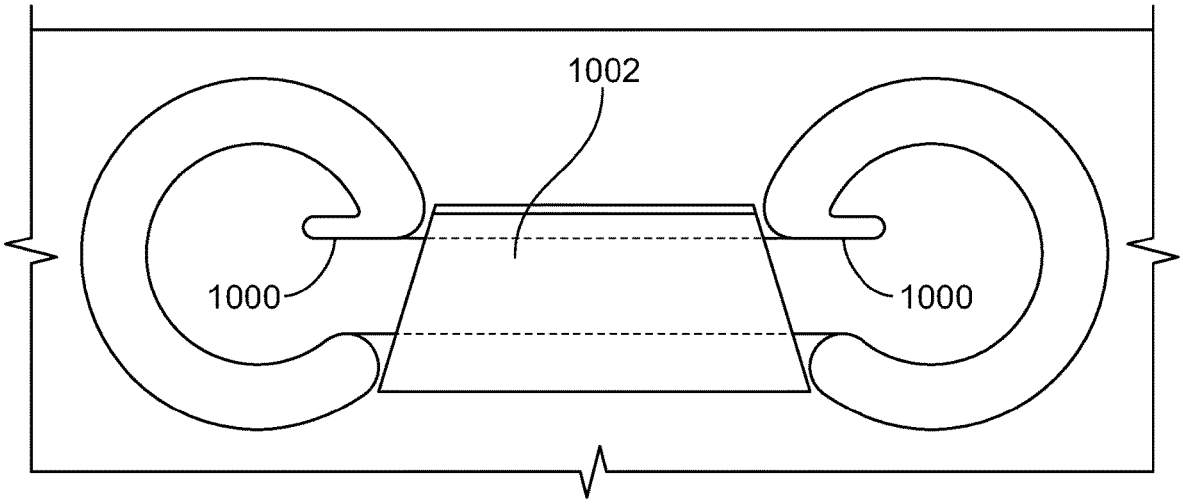
FIG. 36 is a front view of a component of an alternative embodiment of the ring-slit mechanism of the present invention for a curtain for use with the track system of the present invention, including a flap for the ring-slit mechanism.
Figure 37:
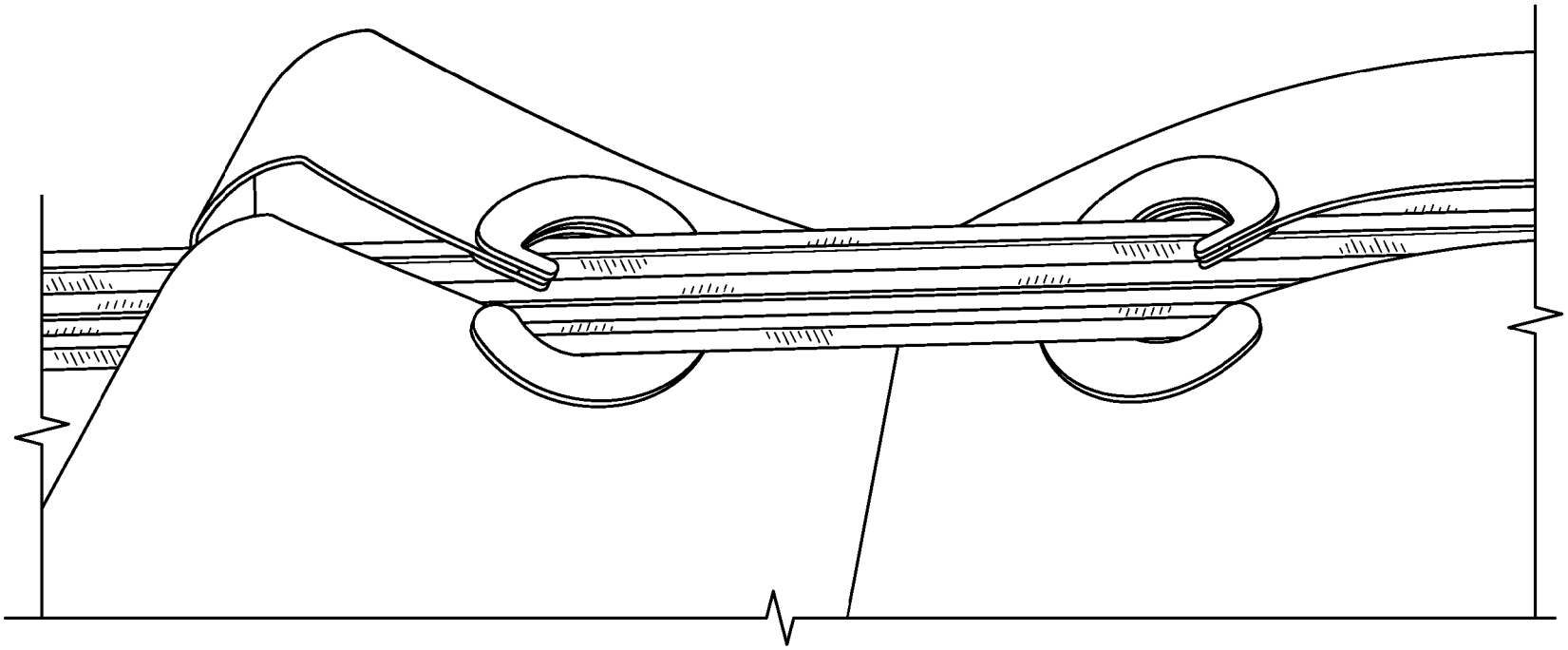
FIG. 37 is a perspective bottom view of a curtain including a double ring-slit mechanism embodiment.

Since the curtain is attached onto the track (rather than hanging a distance below it) it also allows less light to enter, when that is desirable. Moreover, a modular adaptor can be used to adjust the distance between the track and curtain (e.g. to provide a greater distance between the curtain and track, to lower the curtain if needed or desired). In an alternative embodiment, a flap 1002, as shown in FIG. 36, can be used to block the light from shining through the space between the rings of the curtain. The flap can be made out of various fabrics and materials known in the art and suitable for blocking light, such as the same material as the curtain itself. Alternatively, or additionally, a separate mesh header can be provided for attachment to a lower section of curtain (via snaps or VELCRO® etc.) to allow for compliance with fire suppression codes where applicable.

In further embodiments, sections of the curtain can be provided with built-in pockets to hold medical charts, medication, or so forth. Disposable curtains can be provided as discussed above and any other features desired can also be included with the disposable or regular curtains, whether integrated air fresheners and/or anti-bacterial treatments, liquid dispensers, or so forth. Varieties of curtains can be provided of different light transmittivity for different applications, whether opaque, translucent, or transparent, as needed. Similarly, different degrees of sound blockage can be provided (e.g. based on the thickness and composition of the material), without making the curtain unduly unwieldy or heavy due to the ability to use modular sections of much smaller size.

Having described the invention with respect to particular embodiments, it will be understood that the description is not intended to be limiting, it being apparent that modifications can be made without departing from the spirit of the invention described herein. For example, various dimensions, shapes and so forth are merely for illustration of various preferred embodiments and are not intended as limitations upon the scope of the invention hereon. Likewise, as a further example, while a modular system is preferred, the teachings of the present invention can alternately be applied to a non-modular as well. The scope of the present application and invention is intended to cover all such modifications and variations as would be apparent to one of ordinary skill in the art, and all equivalents to the embodiments described herein.

The above description and drawings are considered that of the preferred embodiments of the present invention only. Modifications of the invention will occur to those skilled in the art and to those who make or use the invention. Therefore it is understood that the embodiments shown in the drawings are merely for illustrative purposes only and are not intended to limit the scope of the invention.

I claim:

1. An article of manufacture, comprising:

a curtain configured to hang from and slide along a track having an outer first surface, a side support, and a guiderail, wherein the side support extends away from the first surface of the track, and wherein the guiderail extends away from the first surface of the track;

said curtain comprising a ring, said ring comprising a mouth;

said ring comprising an extension to form a G-shaped ring;

wherein said curtain can move along the track such that the side support of the track moves through said mouth of said G-shaped ring;

and wherein said curtain is configured to move along the guiderail of the track, such that said extension of said G-shaped ring moves along the guiderail of the track, and wherein said extension is not inserted into a cavity in said track.

2. An article of manufacture as claimed in claim 1, and wherein said curtain is configured such that said extension of said G-shaped ring moves above the guiderail of the track.

3. An article of manufacture as claimed in claim 2, wherein the track has an outer second surface, and wherein the outer second surface is substantially flat.

4. An article of manufacture as claimed in claim 1, wherein said G-shaped ring is sized and configured to fit on the track such that rotation of said G-shaped ring is restricted by the guiderail of the track when said G-shaped ring is on the track.

5. An article of manufacture, comprising:

a curtain configured to hang from and slide along a track, wherein the track has an outer first surface, a side support, and a guide rail, wherein the track has a substantially flat outer second surface, wherein the side support extends away from the first surface of the track, and wherein the guiderail extends away from the first surface of the track;

a curtain, said curtain comprising a series of rings, each of said rings comprising a mouth;

each of said rings comprising an extension to form a G-shaped ring;

wherein said curtain can move along the track such that the side support of the track moves through each of said mouths of said G-shaped rings;

and wherein said curtain is configured to move along the guiderail of the track, such that each of said extensions of said G-shaped rings moves along the guiderail of the track, and wherein said extension is not inserted into a cavity in said track.

6. An article of manufacture as claimed in claim 5, wherein each of said G-shaped rings is sized and configured to fit on the track such that rotation of each of said G-shaped rings is restricted by the guiderail of the track when said G-shaped rings are on the track.

7. An article of manufacture as claimed in claim 5, and wherein the curtain is configured such that each extension of said G-shaped rings moves above the guiderail of the track.

* * * * *